US011105066B2

(12) United States Patent
Chiba et al.

(10) Patent No.: US 11,105,066 B2
(45) Date of Patent: Aug. 31, 2021

(54) WORK MACHINE

(71) Applicant: HITACHI CONSTRUCTION MACHINERY CO., LTD., Tokyo (JP)

(72) Inventors: Takaaki Chiba, Kasumigaura (JP); Hiroaki Tanaka, Kasumigaura (JP); Hisami Nakano, Tsuchiura (JP); Hiroshi Sakamoto, Hitachi (JP); Yusuke Suzuki, Tsuchiura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 196 days.

(21) Appl. No.: 16/486,917

(22) PCT Filed: Mar. 15, 2018

(86) PCT No.: PCT/JP2018/010351
§ 371 (c)(1),
(2) Date: Aug. 19, 2019

(87) PCT Pub. No.: WO2019/176075
PCT Pub. Date: Sep. 19, 2019

(65) Prior Publication Data

US 2020/0277751 A1 Sep. 3, 2020

(51) Int. Cl.
*E02F 3/43* (2006.01)
*E02F 3/32* (2006.01)
(Continued)

(52) U.S. Cl.
CPC ..... *E02F 3/435* (2013.01); *E02F 3/32* (2013.01); *E02F 3/38* (2013.01); *E02F 3/425* (2013.01);
(Continued)

(58) Field of Classification Search
CPC ..... E02F 3/435; E02F 9/2203; E02F 9/2228; F15B 2215/305; F15B 11/20
See application file for complete search history.

(56) References Cited

U.S. PATENT DOCUMENTS 5,446,981 A * 9/1995 Kamada ..... E02F 3/437 172/2
5,752,333 A 5/1998 Nakagawa et al.
(Continued)

FOREIGN PATENT DOCUMENTS

JP 09-053259 A 2/1997
JP 10-252093 A 9/1998
(Continued)

OTHER PUBLICATIONS

International Preliminary Report on Patentability received in corresponding International Application No. PCT/JP2018/010351 dated Sep. 24, 2020.
(Continued)

*Primary Examiner* — Abiy Teka
(74) *Attorney, Agent, or Firm* — Mattingly & Malur, PC

(57) ABSTRACT

Target speeds of an arm cylinder and a boom cylinder are computed in response to a distance D between a bucket tip end and a target surface in such a manner that an operating range of a work device is limited on and above the target surface at a time of operating an operation device. A second flow control valve that supplies a hydraulic operating fluid from a second hydraulic pump to the boom cylinder is controlled on the basis of the target speed of the boom cylinder while a first flow control valve that supplies a hydraulic operating fluid from a first hydraulic pump to the arm cylinder and a third flow control valve that supplies the
(Continued)

hydraulic operating fluid from the second hydraulic pump to the arm cylinder are controlled on the basis of the target speed of the arm cylinder.

6 Claims, 16 Drawing Sheets

(51) Int. Cl.

| | |
|---|---|
| ***E02F 3/38*** | (2006.01) |
| ***E02F 3/42*** | (2006.01) |
| ***E02F 9/20*** | (2006.01) |
| ***E02F 9/22*** | (2006.01) |
| ***E02F 9/26*** | (2006.01) |
| ***F15B 11/046*** | (2006.01) |
| ***F15B 11/17*** | (2006.01) |
| ***F15B 11/20*** | (2006.01) |

(52) U.S. Cl.

CPC ..... *E02F 9/2004* (2013.01); *E02F 9/2033* (2013.01); *E02F 9/2203* (2013.01); *E02F 9/2228* (2013.01); *E02F 9/2267* (2013.01); *E02F 9/2271* (2013.01); *E02F 9/2292* (2013.01); *E02F 9/262* (2013.01); *F15B 11/046* (2013.01); *F15B 11/17* (2013.01); *F15B 11/20* (2013.01); *F15B 2211/20523* (2013.01); *F15B 2211/20546* (2013.01); *F15B 2211/20576* (2013.01); *F15B 2211/40576* (2013.01); *F15B 2211/6336* (2013.01); *F15B 2211/6654* (2013.01); *F15B 2211/71* (2013.01); *F15B 2211/75* (2013.01); *F15B 2211/78* (2013.01)

(56) References Cited

U.S. PATENT DOCUMENTS

| | | | | |
|---|---|---|---|---|
| 6,098,322 | A * | 8/2000 | Tozawa | E02F 3/437 37/414 |
| 9,662,917 | B2 * | 5/2017 | Shinkai | B41J 11/0075 |
| 9,667,251 | B1 * | 5/2017 | Chandrasekharan | H03K 19/20 |
| 9,739,038 | B2 * | 8/2017 | Baba | E02F 9/262 |
| 2018/0266083 | A1 | 9/2018 | Narikawa et al. | |

FOREIGN PATENT DOCUMENTS

| | | | |
|---|---|---|---|
| JP | 11-350537 | A | 12/1999 |
| JP | 2017-71982 | A | 4/2017 |

OTHER PUBLICATIONS

International Search Report of PCT/JP2018/010351 dated Jun. 12, 2018.

Chinese Office Action received in corresponding Chinese Application No. 201880013510.9 dated Feb. 25, 2021.

* cited by examiner

VECTOR V0 BEFORE CORRECTION BASED ON DISTANCE D

VECTOR V1 AFTER CORRECTION BASED ON DISTANCE D

WORK MACHINE

TECHNICAL FIELD

The present invention relates to a work machine.

BACKGROUND ART

In general, a hydraulic system of a work machine using hydraulic pressures as power is configured with a plurality of hydraulic pumps, a plurality of hydraulic actuators, and a plurality of flow control valves for controlling hydraulic operating fluids supplied from the plurality of hydraulic pumps to the plurality of hydraulic actuators. Main Examples of the hydraulic system of this type include an open center system configured with flow control valves each capable of changing a bleed-off flow rate of a hydraulic operating fluid from a center bypass line in response to a load of a corresponding hydraulic actuator, and a closed center load sensing system configured with flow control valves each capable of supplying a hydraulic operating fluid at a flow rate irrespective of a load but in response to a throttle opening degree to a corresponding hydraulic actuator by means of a function of a pressure compensating valve. The open center system is excellent in operability of a front work device, while the closed center load sensing system is excellent in controllability of the front work device at the time of combined operation.

Furthermore, there is known an area limiting function to control the front work device in such a manner as to prevent the entry of a control point (for example, a bucket claw tip) of the front work device into a design surface in a hydraulic excavator that is a mode of the work machine.

In a case of applying the area limiting function to a hydraulic system such as a commonly used open center system for joining and diverting hydraulic operating fluids supplied from the plurality of hydraulic pumps to control speeds of the hydraulic actuators, diversion amounts of the hydraulic operating fluids possibly vary among the hydraulic actuators depending on whether or not the combined operation of the hydraulic actuators is performed or magnitudes of the loads of the hydraulic actuators even with the same throttle opening degrees of the flow control valves. This possibly reduces the controllability of each hydraulic actuator and aggravates work execution accuracy.

According to Patent Document 1, computing an error in a controlled operation of each hydraulic actuator from a deviation between a target surface and a control point at a time of the combined operation of a plurality of hydraulic actuators and correcting current-controlled variable characteristics on the basis of the error enable accurate control over each hydraulic actuator even in the combined operation.

PRIOR ART DOCUMENT

Patent Document

Patent Document 1: JP-11-350537-A

SUMMARY OF THE INVENTION

Problem to be Solved by the Invention

However, the actuator loads at the time of excavation change moment by moment in actual work execution. For that reason, even if the current-controlled variable characteristics are corrected in response to the deviation between the target surface and the control point at certain time of the combined operation as disclosed in Patent Document 1, the following problems possibly occur. The diversion amounts still vary among the hydraulic actuators and the work execution accuracy deteriorates in a case in which the actuator loads differ from those at the time of correction.

The present invention has been achieved in the light of circumstances of the related art described above, and an object of the present invention is to provide a work machine that can accurately control each hydraulic actuator irrespectively of a load of the hydraulic actuator when controllability is prioritized, and that can ensure favorable operability when the operability is prioritized.

Means for Solving the Problem

To attain the object, a work machine according to an aspect of the present invention is a work machine including: a multijoint work device having an arm and a boom; a plurality of hydraulic actuators that includes an arm cylinder for driving the arm and a boom cylinder for driving the boom; an operation device for operating the work device; a first hydraulic pump and a second hydraulic pump driven by a prime mover; a first flow control valve that controls a flow rate of a hydraulic operating fluid supplied from the first hydraulic pump to the arm cylinder; a second flow control valve that controls a flow rate of a hydraulic operating fluid supplied from the second hydraulic pump to the boom cylinder; a third flow control valve that controls a flow rate of the hydraulic operating fluid supplied from the second hydraulic pump to the arm cylinder; and a control device that controls the first, second, and third flow control valves, the control device including: a control point position computing section that computes position information regarding a predetermined control point of the work device from posture information regarding the work device; a distance computing section that computes a distance between the control point and a predetermined target surface on the basis of the position information regarding the control point and position information regarding the predetermined target surface; a target speed computing section that computes target speeds of the arm cylinder and the boom cylinder in response to the distance in such a manner that an operating range of the work device is limited on and above the target surface; and a flow control valve control section that controls the second flow control valve on the basis of the target speed of the boom cylinder while controlling the first flow control valve and the third flow control valve on the basis of the target speed of the arm cylinder in a case in which a first work mode for prioritizing operability of the work device is selected as a work mode of the work machine, and that controls the second flow control valve on the basis of the target speed of the boom cylinder while controlling the first flow control valve on the basis of the target speed of the arm cylinder in a case in which a second work mode for prioritizing controllability of the work device is selected as the work mode of the work machine.

Advantages of the Invention

According to the present invention, it is possible to accurately control each hydraulic actuator irrespectively of a load of the hydraulic actuator since diversion of hydraulic operating fluids among the hydraulic actuators is prevented when controllability is prioritized, and it is possible to ensure favorable operability since joint and diversion of the hydraulic operating fluids among the hydraulic actuators are permitted when the operability is prioritized.

BRIEF DESCRIPTION OF THE DRAWINGS

FIG. 2 is an explanatory diagram of a boom angle θ1, an arm angle θ2, a bucket angle θ3, a machine body longitudinal inclination angle θ4, and the like.

MODES FOR CARRYING OUT THE INVENTION

A work machine according to embodiments of the present invention will be described hereinafter with reference to the drawings.

Figure 1:
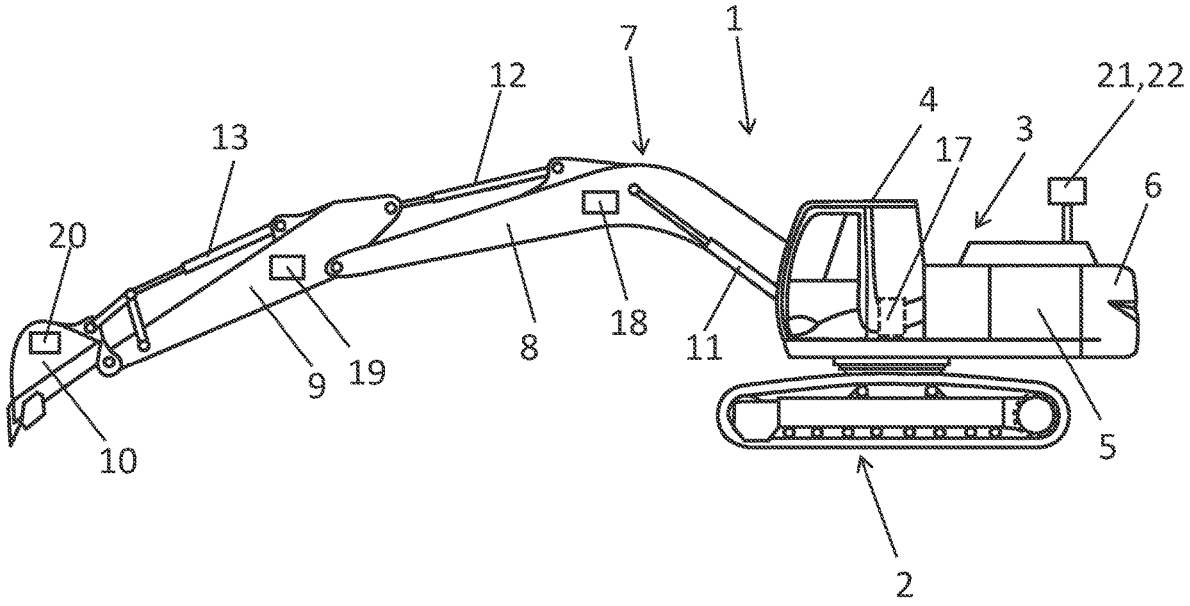
FIG. 1 is a side view of a hydraulic excavator 1 that is an example of a work machine according to embodiments of the present invention.

FIG. 1 is a side view of a hydraulic excavator 1 that is an example of the work machine according to the embodiments of the present invention. The hydraulic excavator 1 is configured with travel structures (lower travel structures) 2 driven the crawler belt by hydraulic motors (not depicted) provided on left and right side portions, respectively, and a swing structure (upper swing structure) 3 swingably provided on the travel structures 2.

The swing structure 3 has an operation room 4, a machine room 5, and a counterweight 6. The operation room 4 is provided in a left side portion in a front portion of the swing structure 3. The machine room 5 is provided rearward of the operation room 4. The counterweight is provided rearward of the machine room 5, that is, on a rear end of the swing structure 3.

In addition, the swing structure 3 is equipped with a multijoint work device 7. The work device 7 is provided rightward of the operation room 4 in the front portion of the swing structure 3, that is, in a generally central portion in the front portion of the swing structure 3. The work device 7 has a boom 8, an arm 9, a bucket (work tool) 10, a boom cylinder 11, an arm cylinder 12, and a bucket cylinder 13. A base end portion of the boom 8 is rotatably attached to the front portion of the swing structure 3 via a boom pin P1 (refer to FIG. 2). A base end portion of the arm 9 is rotatably attached to a tip end portion of the boom 8 via an arm pin P2 (refer to FIG. 2). A base end portion of the bucket 10 is rotatably attached to a tip end portion of the arm 9 via a bucket pin P3 (refer to FIG. 2). The boom cylinder 11, the arm cylinder 12, and the bucket cylinder 13 are hydraulic cylinders each driven by a hydraulic operating fluid. The boom cylinder 11 expands and contracts to drive the boom 8, the arm cylinder 12 expands and contracts to drive the arm 9, and the bucket cylinder 13 expands and contracts to drive the bucket 10. It is noted that the boom 8, the arm 9, and the bucket (work tool) 10 are often referred to as "front implement members," hereinafter.

A variable displacement first hydraulic pump 14 and a variable displacement second hydraulic pump 15 (refer to FIG. 3), as well as an engine (prime mover) 16 (refer to FIG. 3) that drives the first hydraulic pump 14 and the second hydraulic pump 15 are installed within the machine room 5.

A machine body inclination sensor 17 is attached within the operation room 4, a boom inclination sensor 18 is attached to the boom 8, an arm inclination sensor 19 is attached to the arm 9, and a bucket inclination sensor 20 is attached to the bucket 10. The machine body inclination sensor 17, the boom inclination sensor 18, the arm inclination sensor 19, and the bucket inclination sensor 20 are, for example, IMUs (Inertial Measurement Units). The machine body inclination sensor 17 measures an angle (ground angle) of the upper swing structure (machine body) 3 with respect to a horizontal surface, the boom inclination sensor 18 measures a ground angle of the boom with respect to the horizontal surface, the arm inclination sensor 19 measures a ground angle of the arm 9 with respect to the horizontal surface, and the bucket inclination sensor 20 measures a ground angle of the bucket 10 with respect to the horizontal surface.

A first GNSS antenna 21 and a second GNSS antenna 22 are attached left and right in a rear portion of the swing structure 3, respectively. Position information regarding predetermined two points (for example, positions of base end portions of the antennas 21 and 22) in a global coordinate system can be calculated from navigation signals received by each of the antennas 21 and 22 from a plurality of navigation satellites (preferably four or more satellites). In addition, it is possible to calculate coordinate values of an origin P0 (refer to FIG. 2), which is in a local coordinate system (machine body reference coordinate system) set to the hydraulic excavator 1, in the global coordinate system and postures of three axes that configure the local coordinate system (that is, postures and azimuths of the travel structures 2 and the swing structure 3 in an example of FIG. 2) in the global coordinate system, from the calculated position information regarding (coordinate values of) the two points in the global coordinate system. A controller 25, to be described later, can perform computing processes on various positions based on such navigation signals.

Figure 2:
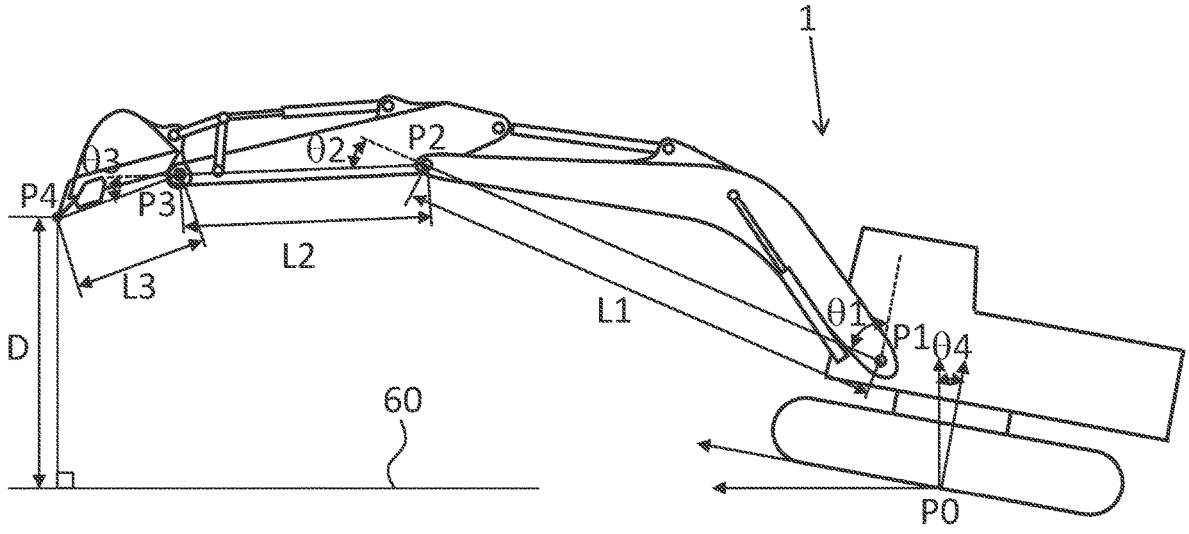

FIG. 2 is a side view of the hydraulic excavator 1. As depicted in FIG. 2, it is assumed that a length of the boom 8, that is, a length from the boom pin P1 to the arm pin P2 is L1. It is also assumed that a length of the arm 9, that is, a length from the arm pin P2 to the bucket pin P3 is L2. It is further assumed that a length of the bucket 10, that is, a length from the bucket pin P3 to a bucket tip end (claw tip of the bucket 10) P4 is L3. Furthermore, it is assumed that an inclination angle of the swing structure 3 with respect to the global coordinate system, that is, an angle formed between a vertical direction of the horizontal surface (direction perpendicular to the horizontal surface) and a machine body vertical direction (direction of a swing central axis of the swing structure 3) is θ4. The inclination angle will be referred to as "machine body longitudinal inclination angle θ4," hereinafter. It is assumed that an angle formed between a segment connecting the boom pin P1 to the arm pin P2 and the machine body vertical direction is θ1, and the angle will be referred to as "boom angle θ1," hereinafter. It is assumed that an angle formed between a segment connecting the arm pin P2 to the bucket pin P3 and a straight line formed by the boom pin P1 and the arm pin P2 is θ2, and the angle will be referred to as "arm angle θ2," hereinafter. It is assumed that a segment connecting the bucket pin P3 to the bucket tip end P4 and a straight line formed by the arm pin P2 and the bucket pin P3 is θ3, and the angle will be referred to as "bucket angle θ3," hereinafter.

Figure 3:
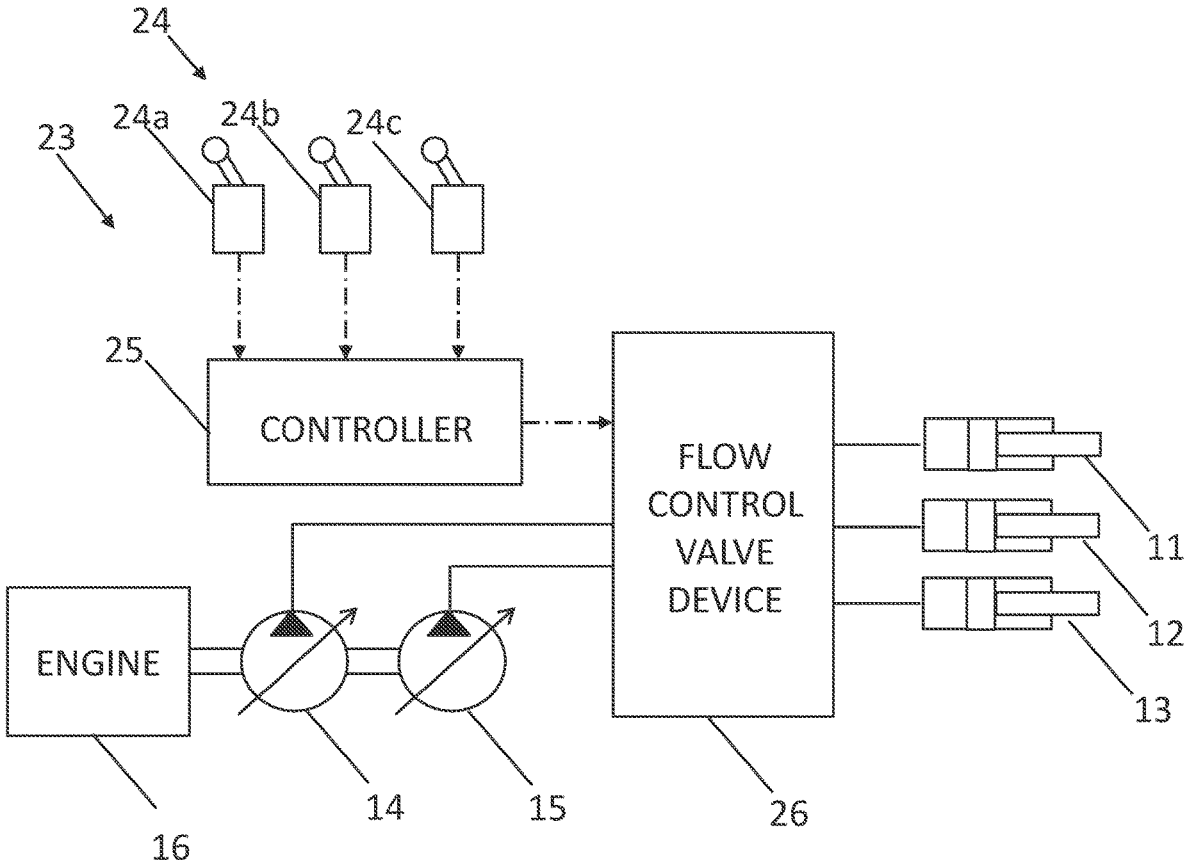
FIG. 3 is a configuration diagram of a machine body control system 23 of the hydraulic excavator 1.

FIG. 3 depicts a configuration of a machine body control system 23 of the hydraulic excavator 1. The machine body control system 23 is configured with an operation device 24 for operating the work device 7, the engine 16 that drives the first and second hydraulic pumps 14 and 15, a flow control valve device 26 that controls flow rates and directions of hydraulic operating fluids supplied from the first and second hydraulic pumps 14 and 15 to the boom cylinder 11, the arm cylinder 12, and the bucket cylinder 13, and the controller 25 that is a control device controlling the flow control valve device 26.

The operation device 24 has a boom operation lever 24*a* for operating the boom 8 (boom cylinder 11), an arm operation lever 24*b* for operating the arm 9 (arm cylinder 12), and a bucket operation lever 24*c* for operating the bucket 10 (bucket cylinder 13). The respective operation levers 24*a*, 24*b*, and 24*c* are, for example, electric levers and output voltage values in response to tilting amounts (operation amounts) of the respective levers. The boom operation lever 24*a* outputs a target operation amount (hereinafter, referred to as "boom operation amount") of the boom cylinder 11 as the voltage value in response to the operation amount of the boom operation lever 24*a*. The arm operation lever 24*b* outputs a target operation amount (hereinafter, referred to as "arm operation amount") of the arm cylinder 12 as the voltage value in response to the operation amount of the arm operation lever 24*b*. The bucket operation lever 24*c* outputs a target operation amount (hereinafter, referred to as "bucket operation amount") of the bucket cylinder 13 as the voltage value in response to the operation amount of the bucket operation lever 24*c*. Alternatively, the respective operation levers 24*a*, 24*b*, and 24*c* may be hydraulic pilot levers and detect the respective operation amounts by converting pilot pressures generated in response to the tilting amounts of the respective levers 24*a*, 24*b*, and 24*c* into voltage values by a pressure sensor (not depicted) and outputting the voltage values to the controller 25.

The controller 25 computes control commands on the basis of the operation amounts output from the operation device 24, position information (control point position information) regarding the bucket tip end P4 that is a predetermined control point set to the work device 7 in advance, position information (target surface information) regarding a target surface 60 (refer to FIG. 2) stored in the controller 25 in advance, and outputs the control commands to the flow control valve device 26. The controller 25 in the present embodiment computes target speeds of the arm cylinder 12 and the boom cylinder 11 in response to a distance (target surface distance) D between the bucket tip end P4 (control point) and the target surface 60 (refer to FIG. 2) in such a manner that an operating range of the work device 7 is limited on and above the target surface 60 at a time of operating the operation device 24. While the bucket tip end P4 (claw tip of the bucket 10) is set as the control point of the work device 7 in the present embodiment, an arbitrary point on the work device 7 can be set to the control point. For example, a point that is a part closer to the tip end than the arm 9 in the work device 7 and that is closest to the target surface 60 may be set to the control point.

Figure 4:
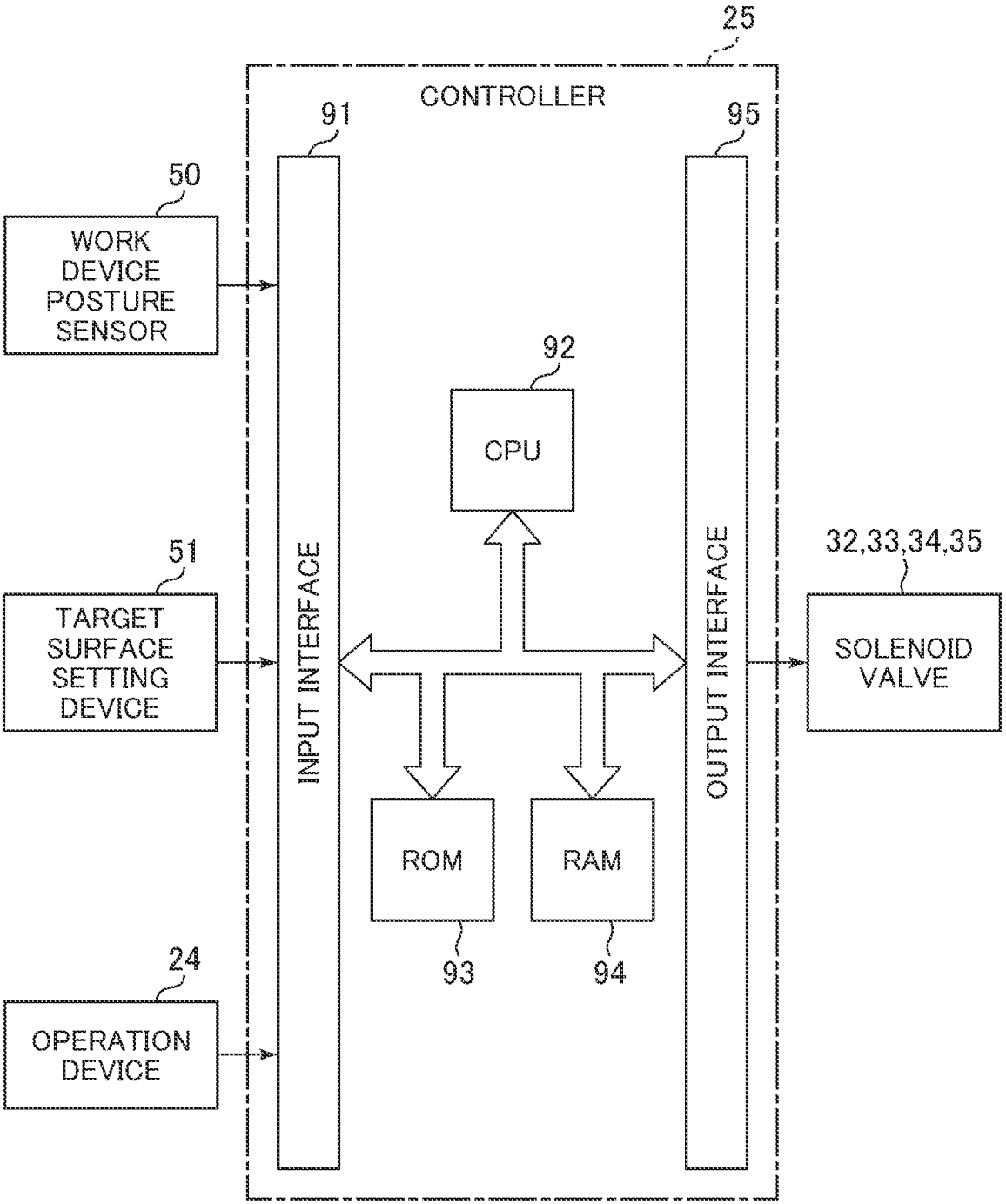
FIG. 4 is a schematic diagram of a hardware configuration of a controller 25.

FIG. 4 is a schematic diagram of a hardware configuration of the controller 25. In FIG. 4, the controller 25 has an input interface 91, a central processing unit (CPU) 92 that is a processor, a read only memory (ROM) 93 and a random access memory (RAM) 94 that are storage devices, and an output interface 95. Signals from the inclination sensors 17, 18, 19, and 20 that serve as a work device posture sensor 50 that detects postures of the work device 7, the voltage values (signals) from the operation device 24 that indicate the operation amounts of the respective operation levers 24*a*, 24*b*, and 24*c*, and a signal from a target surface setting device 51 that is a device for setting the target surface 60 serving as a reference of excavation work and filling work by the work device 7 are input to the input interface 91, and the input interface 91 converts the signals so that the CPU 92 can perform computing. The ROM 93 is a recording medium in which a control program for the controller 25 to execute various control processes including processes related to a flowchart to be described later, various information necessary for the controller 25 to execute the various control processes, and the like are stored. The CPU 92 performs predetermined computing processes on the signals imported from the input interface 91, the ROM 93, and the RAM 94 in accordance with the control program stored in the ROM 93. The output interface 95 creates signals for output in response to a computing result of the CPU 92 and outputs the signals. The signals for output from the output interface 95 include the control commands to solenoid valves 32, 33, 34, and 35 (refer to FIG. 5), and the solenoid valves 32, 33, 34, and 35 operate on the basis of the control commands and control the hydraulic cylinders 11, 12, and 13. While the controller 25 of FIG. 4 is configured with semiconductor memories that are the ROM 93 and the RAM 94 as the storage devices, the controller 25 may be configured with other devices as an alternative to the ROM 93 and the RAM 94 as long as the devices are storage devices. The controller 25 may be configured with, for example, magnetic storage devices such as hard disk drives.

The flow control valve device 26 is configured with a plurality of electromagnetically driven spools, and drives a plurality of hydraulic actuators including the hydraulic cylinders 11, 12, and 13 and mounted in the hydraulic excavator 1 by changing opening areas (throttle opening degrees) of the spools on the basis of the control commands output from the controller 25.

Figure 5:
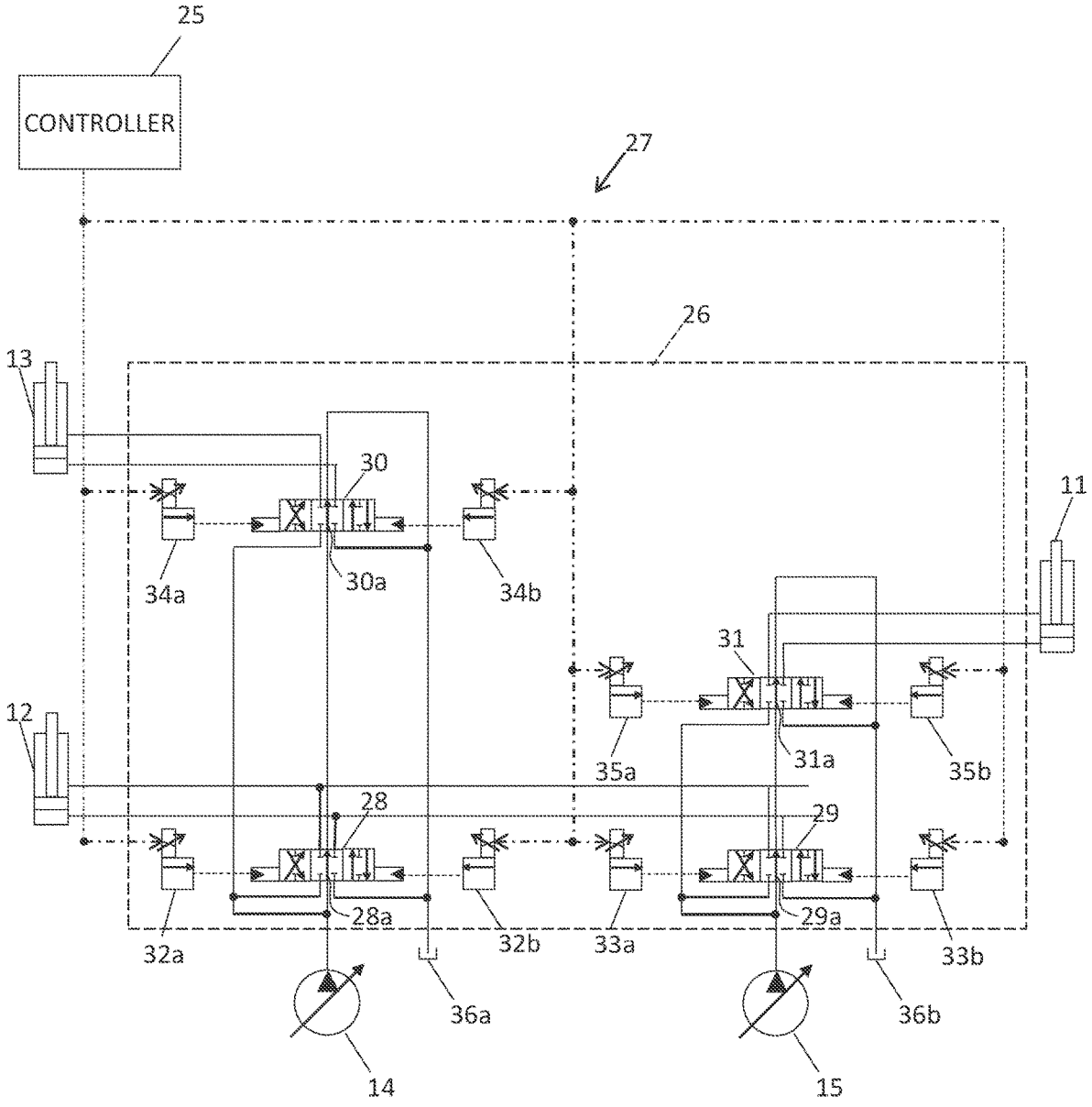
FIG. 5 is a schematic diagram of a hydraulic circuit 27 of the hydraulic excavator 1.

FIG. 5 is a schematic diagram of a hydraulic circuit 27 of the hydraulic excavator 1. The hydraulic circuit 27 is configured with the first hydraulic pump 14, the second hydraulic pump 15, the flow control valve device 26, and hydraulic operating fluid tanks 36*a* and 36*b*.

The flow control valve device 26 is configured with a first arm spool 28 that is a first flow control valve controlling the flow rate of the hydraulic operating fluid supplied from the first hydraulic pump 14 to the arm cylinder 12, a second arm spool 29 that is a third flow control valve controlling the flow rate of the hydraulic operating fluid supplied from the second pump 15 to the arm cylinder 12, a bucket spool 30 controlling the flow rate of the hydraulic operating fluid supplied from the first hydraulic pump 14 to the bucket cylinder 13, a boom spool (first boom spool) 31 that is a second flow control valve controlling the flow rate of the hydraulic operating fluid supplied from the second hydraulic pump 15 to the boom cylinder 11, first arm spool drive solenoid valves 32*a* and 32*b* driving the first arm spool 28, second arm spool drive solenoid valves 33*a* and 33*b* driving the second arm spool 29, bucket spool drive solenoid valves 34*a* and 34*b* driving the bucket spool 30, and boom spool drive solenoid valves (first boom spool drive solenoid valves) 35*a* and 35*b* driving the boom spool 31.

The first arm spool 28 and the bucket spool 30 are connected in parallel to the first hydraulic pump 14, while the second arm spool 29 and the boom spool 31 are connected in parallel to the second hydraulic pump 15.

The flow control valve device 26 is a so-called open center type (center bypass type) flow control valve device. The spools 28, 29, 30, and 31 have center bypass sections 28*a*, 29*a*, 30*a*, and 31*a* that are flow paths for guiding the hydraulic operating fluids delivered from the hydraulic pumps 14 and 15 to the hydraulic operating fluid tanks 36*a* and 36*b* until the spools 28, 29, 30, and 31 reach predetermined spool positions from neutral positions. In the present embodiment, the first hydraulic pump 14, the center bypass section 28*a* of the first arm spool 28, the center bypass section 30*a* of the bucket spool 30, and the tank 36*a* are connected in series in this order, and the center bypass sections 28*a* and 30*a* configure a center bypass line that guides the hydraulic operating fluid delivered from the first hydraulic pump 14 to the tank 36*a*. In addition, the second hydraulic pump 15, the center bypass section 29*a* of the second arm spool 29, the center bypass section 31*a* of the boom spool 31, and the tank 36*b* are connected in series in this order, and the center bypass sections 29*a* and 31*a* configure a center bypass line that guides the hydraulic operating fluid delivered from the second hydraulic pump 15 to the tank 36*b*.

A hydraulic fluid delivered from a pilot pump (not depicted) driven by the engine 16 is guided to the solenoid valves 32, 33, 34, and 35. The solenoid valves 32, 33, 34, and 35 operate as appropriate on the basis of the control commands from the controller 25 to cause the hydraulic fluid from the pilot pump to act on drive sections of the spools 28, 29, 30, and 31, whereby the spools 28, 29, 30, and 31 are driven and the hydraulic cylinders 11, 12, and 13 operate.

For example, in a case in which the controller 25 issues a command in relation to an expansion direction of the arm cylinder 12, commands are issued to the first arm spool drive solenoid valve 32*a* and the second arm spool drive solenoid valve 33*a*. In a case in which the controller 25 issues a command in relation to a contraction direction of the arm cylinder 12, commands are issued to the first arm spool drive solenoid valve 32*b* and the second arm spool drive solenoid valve 33*b*. In a case in which the controller 25 issues a command in relation to an expansion direction of the bucket cylinder 13, a command is issued to the bucket spool drive solenoid valve 34*a*. In a case in which the controller 25 issues a command in relation to a contraction direction of the bucket cylinder 13, a command is issued to the bucket spool drive solenoid valve 34*b*. In a case in which the controller 25 issues a command in relation to an expansion direction of the boom cylinder 11, a command is issued to the boom spool drive solenoid valve 35*a*. In a case in which the controller 25 issues a command in relation to a contraction direction of the boom cylinder 11, a command is issued to the boom spool drive solenoid valve 35*b*.

Figure 6:
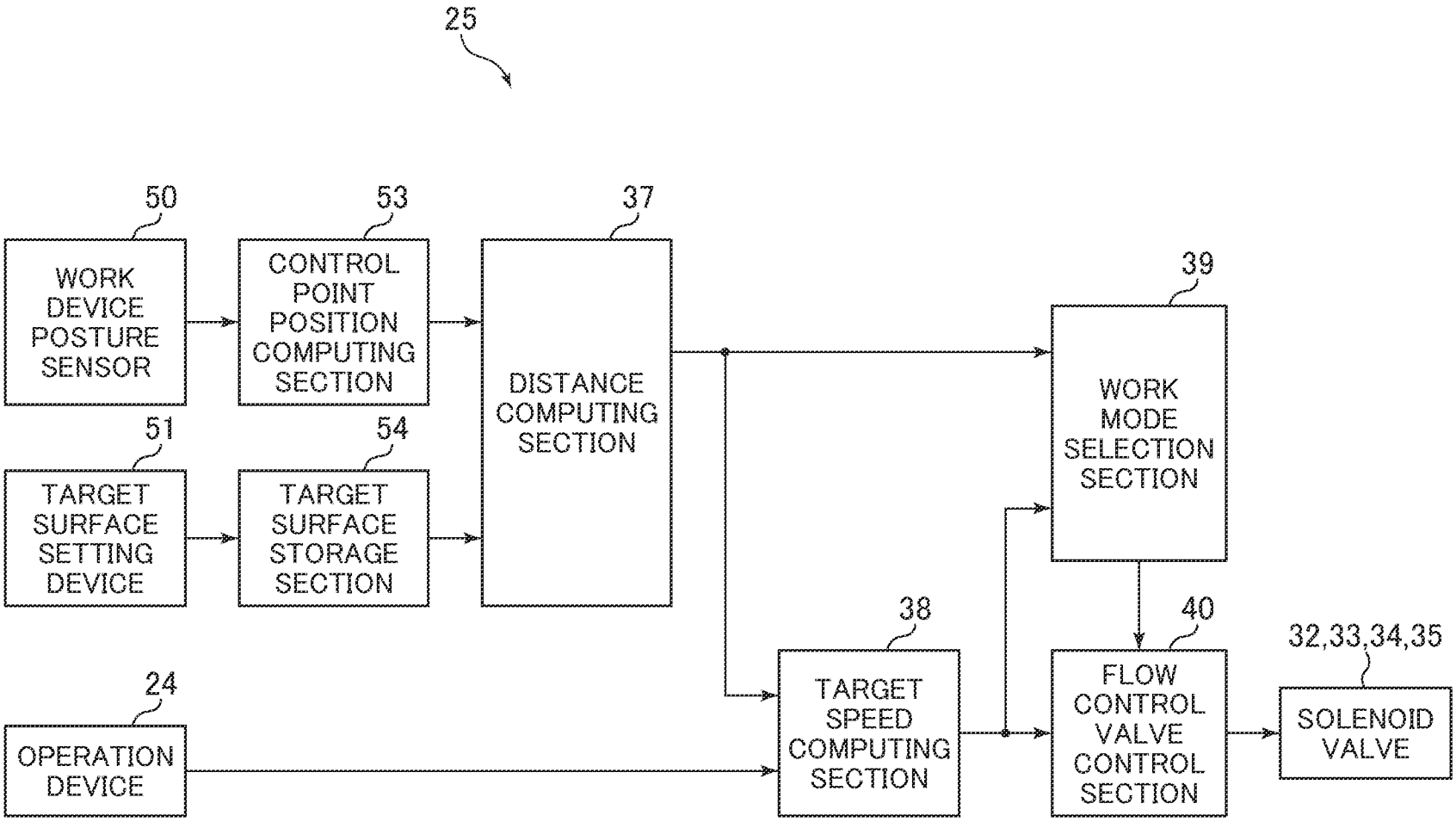
FIG. 6 is a functional block diagram of the controller 25 according to Embodiment 1.

FIG. 6 depicts a functional block diagram in which processes executed by the controller 25 according to the present embodiment are classified and organized into a plurality of blocks in terms of a functional aspect. As depicted in FIG. 6, the processes executed by the controller 25 can be divided into those executed by a control point position computing section 53, a target surface storage section 54, a distance computing section 37, a target speed computing section 38, a work mode selection section 39, and a flow control valve control section 40.

The control point position computing section 53 computes a position of the bucket tip end P4 that is the control point in the present embodiment in the global coordinate system and postures of the front implement members 8, 9, and 10 of the work device 7 in the global coordinate system. While computing may be based on a well-known method, the control point position computing section 53 calculates, for example, first the coordinate values of the origin P0 (refer to FIG. 2), which is in the local coordinate system (machine body reference coordinate system), in the global coordinate system and posture information and azimuth information regarding the travel structures 2 and the swing structure 3 in the global coordinate system from the navigation signals received by the first and second GNSS antennas 21 and 22. In addition, the control point position computing section 53 computes the position of the bucket tip end P4 that is the control point in the present embodiment in the global coordinate system and the postures of the respective front implement members 8, 9, and 10 of the work device 7 in the global coordinate system using information regarding the inclination angles θ1, θ2, θ3, and θ4 from the work device posture sensor 50, the coordinate values of the boom foot pin P1 in the local coordinate system, and the boom length L1, the arm length L2, and the bucket length L3. It is noted that the coordinate values of the control point of the work device 7 may be measured by an external measurement instrument such as a laser surveying instrument and the control point position computing section 53 may acquire the coordinate values by communication with the external surveying instrument.

The target surface storage section 54 stores the position information (target surface data) regarding the target surface 60 in the global coordinate system computed on the basis of information from the target surface setting device 51 provided within the operation room 4. As depicted in FIG. 2, in the present embodiment, a cross-sectional shape obtained by cutting three-dimensional data regarding the target surface by a plane on which the front implement members 8, 9, and 10 of the work device 7 operate (operation plane of the work machine). While the number of target surfaces 60 is one in an example of FIG. 2, a plurality of target surfaces is often present. In a case in which the plurality of target surfaces is present, examples of a method of setting the target surfaces include a method of setting surfaces at a smallest distance from the control point of the work device 7 as the target surfaces, a method of setting surfaces located vertically below the bucket tip end P4 as the target surfaces, and a method of setting arbitrarily selected surfaces as the target surfaces. Furthermore, the position information regarding the target surface 60 around the hydraulic excavator 1 may be acquired from an external server by communication on the basis of the position information regarding the control point of the work device 7 in the global coordinate system and stored in the target surface storage section 54.

The distance computing section 37 computes the distance D (refer to FIG. 2) between the control point of the work device 7 and the target surface 60 from the position information regarding the control point of the work device 7 computed by the control point position computing section 53 and the position information regarding the target surface 60 acquired from the target surface storage section 54.

The target speed computing section 38 is a section that computes the target speeds of the hydraulic cylinders 11, 12, and 13 in response to the distance D in such a manner that the operating range of the work device is limited on and above the target surface 60 at the time of operating the operation device 24. In the present embodiment, the target speed computing section 38 executes the following computing.

First, the target speed computing section 38 calculates a demanded speed (boom cylinder demanded speed) to the boom cylinder 11 from the voltage value (boom operation amount) input from the operation lever 24*a*, calculates a demanded speed to the arm cylinder 12 from the voltage value (arm operation amount) input from the operation lever 24*b*, and calculates a demanded speed to the bucket cylinder 13 from the voltage value (bucket operation amount) input from the operation lever 24*c*. The target speed computing section 38 calculates a speed vector (demanded speed vector) V0 of the work device 7 on the bucket tip end P4 from these three demanded speeds and the postures of the front implement members 8, 9, and 10 of the work device 7 computed by the control point position computing section 53. In addition, the target speed computing section 38 calculates a speed component V0*z* in a target surface vertical direction and a speed component V0*x* in a target surface horizontal direction of the speed vector V0.

Figure 7:
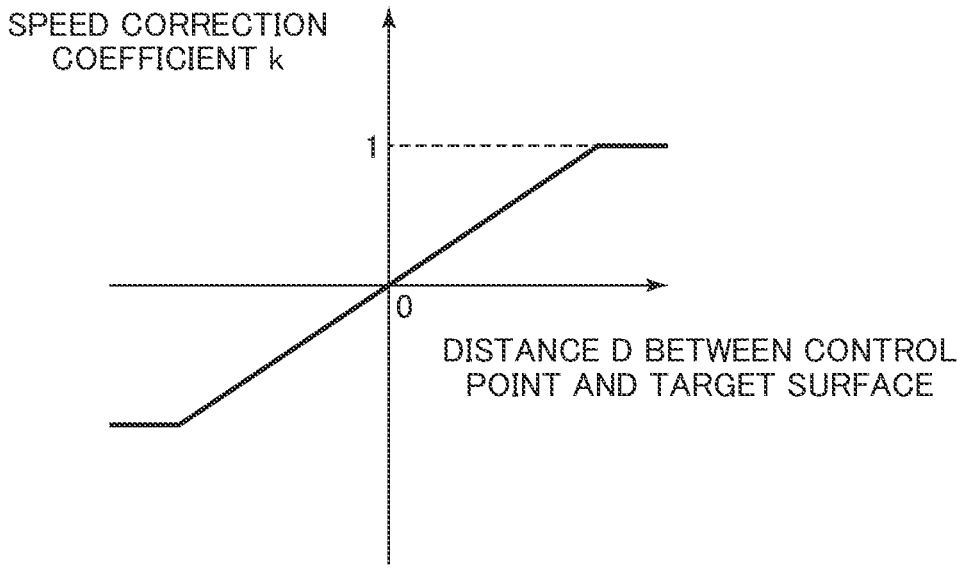
FIG. 7 is a graph depicting a relationship between a distance D, which is between a bucket tip end P4 and a target surface 60, and a speed correction coefficient k.

Next, the target speed computing section 38 computes a correction coefficient k determined in response to the distance D. FIG. 7 is a graph depicting a relationship between the distance D, which is between the bucket tip end P4 and the target surface 60, and the speed correction coefficient k. It is assumed that the distance D is positive when the bucket claw tip coordinate P4 (control point of the work device 7) is located above the target surface 60 and that the distance D is negative when the bucket claw tip coordinate P4 is located below the target surface 60, and the target speed computing section 38 outputs, as a value equal to or smaller than 1, a positive correction coefficient when the distance D is positive and a negative correction coefficient when the distance D is negative. It is noted that the speed vector is assumed as being positive in a direction in which the speed vector approaches the target surface 60 from above the target surface 60.

Next, the target speed computing section 38 calculates a speed component V1*z* by multiplying the speed component V0*z* in the target surface vertical direction of the speed vector V0 by the correction coefficient k determined in response to the distance D. The target speed computing section 38 calculates a resultant speed vector (target speed vector) V1 by combining the speed component V1*z* with the speed component V0*x* in the target surface horizontal direction of the speed vector V0, and computes a boom cylinder speed, an arm cylinder speed (Va1), and a bucket cylinder speed at which the resultant speed vector V1 can be generated, as the target speeds. At a time of computing these target speeds, the target speed computing section 38 may use the postures of the front implement members 8, 9, and 10 of the work device 7 computed by the control point position computing section 53.

Figure 8:
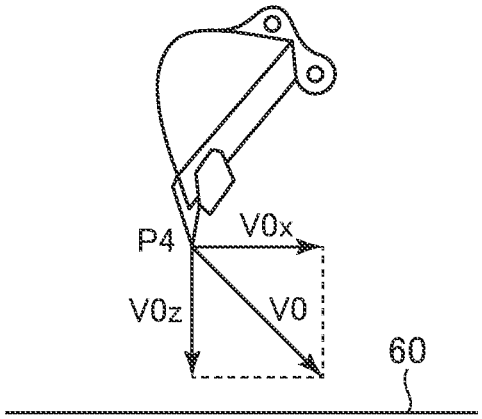
FIG. 8 is a schematic diagram depicting speed vectors on the bucket tip end P4 before and after a correction in response to the distance D.
Figure 8:
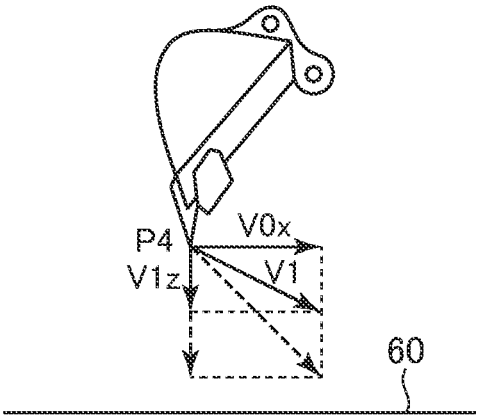

FIG. 8 is a schematic diagram depicting speed vectors on the bucket tip end P4 before and after a correction in response to the distance D. The target speed computing section 38 obtains the speed vector V1*z* (refer to a right-side view of FIG. 8) in the target surface vertical direction so that the speed vector V1*z* is equal to or smaller than the component V0*z* (refer to a left-side view of FIG. 8) in the target surface vertical direction of the demanded speed vector V0 by multiplying the component V0*z* by the speed correction coefficient k. The target speed computing section 38 calculates the resultant speed vector V1 by combining V1*z* with the speed component V0*x* in the target surface horizontal direction of the demanded speed vector V0, and calculates the arm cylinder target speed Va1, the boom cylinder target speed, and the bucket cylinder target speed at which V1 can be output.

The work mode selection section 39 selects a work mode of the hydraulic excavator 1 on the basis of the target speed Va1 of the arm cylinder 12 and the distance D. Work modes to be selected herein include a "first work mode (operability priority mode)" for prioritizing operability (responsiveness) over controllability of the work device 7 and a "second work mode (controllability priority mode)" for prioritizing the controllability over the operability of the work device 7. More specifically, the work mode selection section 39 assumes that the distance D is positive when the bucket claw tip coordinate P4 (control point of the work device 7) is located above the target surface 60, selects the first work mode when the target speed Va1 of the arm cylinder 12 is higher than a predetermined speed threshold V0, selects the first work mode when the distance D is equal to or larger than a predetermined distance threshold D0, and selects the second work mode when the target speed Va1 of the arm cylinder 12 is lower than the speed threshold V0 and the distance D is smaller than the distance threshold D0.

In the present embodiment, the speed threshold V0 is assumed as a maximum speed Va1max of the arm cylinder 11 corresponding to a maximum flow rate at which the hydraulic operating fluid can be supplied from the first hydraulic pump 14. The distance threshold D0 is assumed as a value equal to or greater than 0, that is, a positive value.

The flow control valve control section 40 is a section that computes the control commands to the solenoid valves 32, 33, 34, and 35 on the basis of the work mode selected by the work mode selection section 39 and the target speeds of the hydraulic cylinders 11, 12, and 13 computed by the target speed computing section 38, and that controls the flow control valves (spools) 28, 29, 30, and 31 by outputting the control commands to the corresponding solenoid valves 32, 33, 34, and 35.

Figure 9:
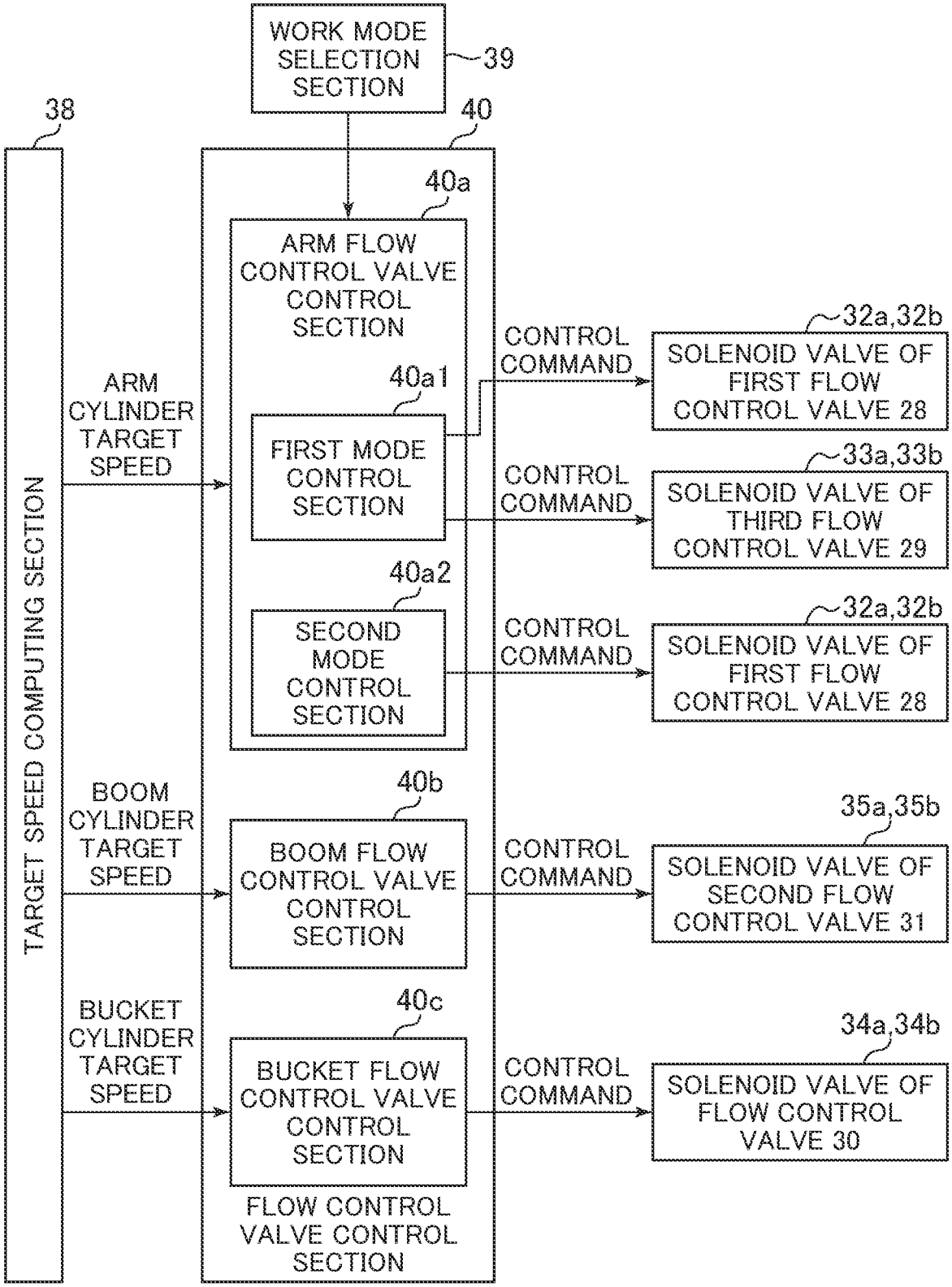
FIG. 9 is a functional block diagram of a flow control valve control section 40 according to Embodiment 1.

FIG. 9 is a functional block diagram of the flow control valve control section 40. The flow control valve control section 40 has an arm flow control valve control section 40*a*, a boom flow control valve control section 40*b*, and a bucket flow control valve control section 40*c*.

The arm flow control valve control section 40*a* is configured with a first mode control section 40*a*1 used when the first mode is selected as the work mode of the hydraulic excavator 1, and a second mode control section 40*a*2 used when the second mode is selected as the work mode of the hydraulic excavator 1. With this configuration, the first mode control section 40*a*1 in the arm flow control valve control section 40*a* controls the first flow control valve (first arm spool) 28 and the third flow control valve (second arm spool)

29 on the basis of the target speed of the arm cylinder 12 in a case in which the first work mode is selected as the work mode of the hydraulic excavator 1. On the other hand, the second mode control section 40*a*2 in the arm flow control valve control section 40*a* controls only the first flow control valve (first arm spool) 28 on the basis of the target speed of the arm cylinder 12 in a case in which the second work mode is selected as the work mode of the hydraulic excavator 1.

The target speed of the arm cylinder 12 computed by the target speed computing section 38 is input to the first mode control section 40*a*1, and the first mode control section 40*a*1 computes and outputs control commands to the first arm spool drive solenoid valves 32*a* and 32*b* and the second arm spool drive solenoid valves 33*a* and 33*b* (specifically, command current values specifying valve opening degrees of the first arm spool drive solenoid valves 32*a* and 32*b* and the second arm spool drive solenoid valves 33*a* and 33*b*) corresponding to the target speed. In other words, in the case in which the first mode is selected, the arm cylinder 12 is driven by the hydraulic operating fluids guided from the two arm spools 28 and 29 (that is, two hydraulic pumps 14 and 15). In computing the control commands to the first arm spool drive solenoid valves 32*a* and 32*b* and the second arm spool drive solenoid valves 33*a* and 33*b*, the first mode control section 40*a*1 in the present embodiment uses tables in each of which a one-to-one correlation between the target speed of the arm cylinder 12 and the control commands to the first arm spool drive solenoid valves 32*a* and 32*b* and the second arm spool drive solenoid valves 33*a* and 33*b* is specified. These tables include first a table for the first arm spool drive solenoid valve 32*a* and a table for the second arm spool drive solenoid valve 33*a* as two tables used in a case of expanding the arm cylinder 12. In addition, the tables include a table for the first arm spool drive solenoid valve 32*b* and a table for the second arm spool drive solenoid valve 33*b* as two tables used in a case of contracting the arm cylinder 12. In these four tables, a correlation between the target speed and the current values to the solenoid valves 32*a*, 32*b*, 33*a*, and 33*b* is specified in such a manner that the current values monotonically increase in proportion to an increase in a magnitude of the arm cylinder target speed on the basis of a relationship between the current values to the solenoid valves 32*a*, 32*b*, 33*a*, and 33*b* and an actual speed of the arm cylinder 12 obtained by an experiment or a simulation in advance.

The target speed of the arm cylinder 12 computed by the target speed computing section 38 is input to the second mode control section 40*a*2, and the second mode control section 40*a*2 computes and outputs control commands to the first arm spool drive solenoid valves 32*a* and 32*b* (specifically, command current values specifying valve opening degrees of the first arm spool drive solenoid valves 32*a* and 32*b*) corresponding to the target speed. In other words, in the case in which the second mode is selected, the arm cylinder 12 is driven by the hydraulic operating fluid guided only from one arm spool 28 (that is, only from one hydraulic pump 14). In computing the control commands to the first arm spool drive solenoid valves 32*a* and 32*b*, the second mode control section 40*a*2 in the present embodiment uses tables in each of which a one-to-one correlation between the target speed of the arm cylinder 12 and the control commands to the first arm spool drive solenoid valves 32*a* and 32*b* is specified. These tables include a table for the first arm spool drive solenoid valve 32*a* used in the case of expanding the arm cylinder 12 and a table for the first arm spool drive solenoid valve 32*b* used in the case of contracting the arm cylinder 12. In these two tables, a correlation between the target speed and the current values to the solenoid valves 32*a* and 32*b* is specified in such a manner that the current values monotonically increase in proportion to the increase in the magnitude of the arm cylinder target speed on the basis of a relationship between the current values to the solenoid valves 32*a* and 32*b* and the actual speed of the arm cylinder 12 obtained by an experiment or a simulation in advance.

The target speed of the boom cylinder 11 computed by the target speed computing section 38 is input to the boom flow control valve control section 40*b*, and the boom flow control valve control section 40*b* computes and outputs control commands to the boom spool drive solenoid valves 35*a* and 35*b* (specifically, command current values specifying valve opening degrees of the boom spool drive solenoid valves 35*a* and 35*b*) corresponding to the target speed. In computing the control commands to the boom spool drive solenoid valves 35*a* and 35*b*, the boom flow control valve control section 40*b* in the present embodiment uses tables in each of which a one-to-one correlation between the target speed of the boom cylinder 11 and the control commands to the boom spool drive solenoid valves 35*a* and 35*b* is specified. These tables include a table for the boom spool drive solenoid valve 35*a* used in a case of expanding the boom cylinder 11 and a table for the boom spool drive solenoid valve 35*b* used in a case of contracting the boom cylinder 11. In these two tables, a correlation between the target speed and the current values to the solenoid valves 35*a* and 35*b* is specified in such a manner that the current values monotonically increase in proportion to an increase in a magnitude of the boom cylinder target speed on the basis of a relationship between the current values to the solenoid valves 35*a* and 35*b* and an actual speed of the boom cylinder 11 obtained by an experiment or a simulation in advance. In computing the control commands to the boom spool drive solenoid valves 35*a* and 35*b*, the boom flow control valve control section 40*b* uses the same tables irrespectively of the work mode selected by the work mode selection section 39.

The target speed of the bucket cylinder 13 computed by the target speed computing section 38 is input to the bucket flow control valve control section 40*c*, and the bucket flow control valve control section 40*c* computes and outputs control commands to the bucket spool drive solenoid valves 34*a* and 34*b* (specifically, command current values specifying valve opening degrees of the bucket spool drive solenoid valves 34*a* and 34*b*) corresponding to the target speed. In computing the control commands to the bucket spool drive solenoid valves 34*a* and 34*b*, the bucket flow control valve control section 40*c* in the present embodiment uses tables in each of which a one-to-one correlation between the target speed of the bucket cylinder 13 and the control commands to the bucket spool drive solenoid valves 34*a* and 34*b* is specified. These tables include a table for the bucket spool drive solenoid valve 34*a* used in a case of expanding the bucket cylinder 13 and a table for the bucket spool drive solenoid valve 34*b* used in a case of contracting the bucket cylinder 13. In these two tables, a correlation between the target speed and the current values to the solenoid valves 34*a* and 34*b* is specified in such a manner that the current values monotonically increase in proportion to an increase in a magnitude of the bucket cylinder target speed on the basis of a relationship between the current values to the solenoid valves 34*a* and 34*b* and an actual speed of the bucket cylinder 13 obtained by an experiment or a simulation in advance. In computing the control commands to the bucket spool drive solenoid valves 34*a* and 34*b*, the bucket flow control valve control section 40*c* uses the same tables irrespectively of the work mode selected by the work mode selection section 39.

In the case, for example, in which first work mode is selected and there are commands in relation to the arm cylinder target speed and the boom cylinder target speed, the flow control valve control section 40 generates the control commands to the solenoid valves 32, 33, and 35 and drives the first arm spool 28, the second arm spool 29, and the boom spool 31. On the other hand, in the case in which second work mode is selected and there are commands in relation to the arm cylinder target speed and the boom cylinder target speed, the flow control valve control section 40 generates the control commands to the solenoid valves 32 and 35 and drives the first arm spool 28 and the boom spool 31.

Figure 10:
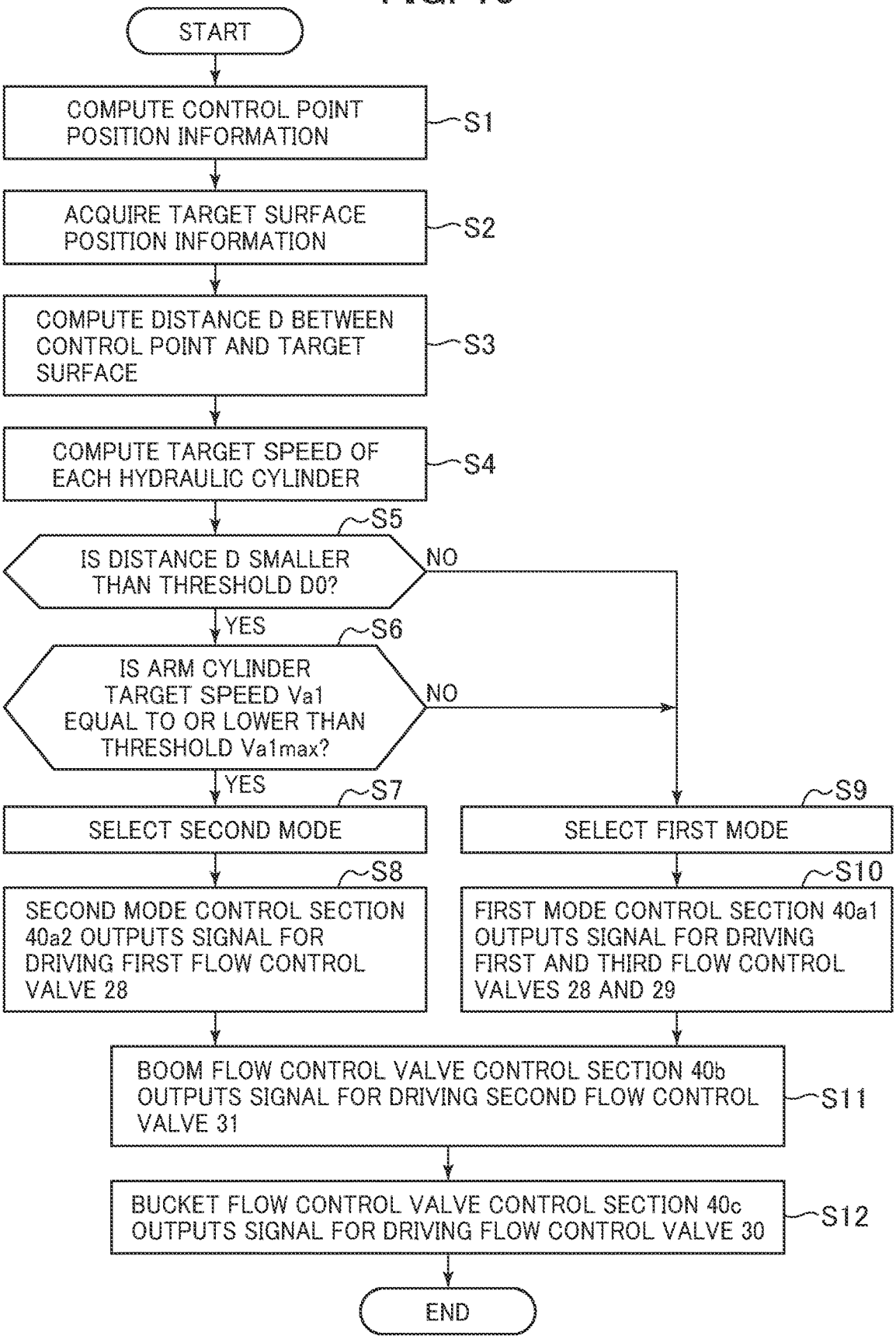
FIG. 10 is a flowchart representing a control flow by the controller 25 according to Embodiment 1.

FIG. 10 is a flowchart representing a control flow by the controller 25. When the operation device 24 is operated by an operator, then the controller 25 starts processes of FIG. 10, and the control point position computing section 53 computes the position information regarding the bucket tip end P4 (control point) in the global coordinate system on the basis of information regarding the inclination angles θ1, θ2, θ3, and θ4 from the work device posture sensor 50, the position information, the posture information (angle information), and the azimuth information regarding the hydraulic excavator 1 computed from the navigation signals from the GNSS antennas 21 and 22, dimension information L1, L2, and L3 regarding the front implement members, and the like (Step S1).

In Step S2, the distance computing section 37 extracts and acquires the position information (target surface data) regarding the target surfaces falling within a predetermined range by the target surface storage section 54 with reference to the position information regarding the bucket tip end P4 in the global coordinate system computed by the control point position computing section 53 (or the position information regarding the hydraulic excavator 1 may be used). In addition, the distance computing section 37 sets the target surface located at a position closest to the bucket tip end P4 as the target surface 60 of an object to be controlled, that is, the target surface 60 for computing the distance D from among the target surfaces.

In Step S3, the distance computing section 37 computes the distance D on the basis of the position information regarding the bucket tip end P4 computed in Step S1 and the position information regarding the target surface 60 set in Step S2.

In Step S4, the target speed computing section 38 computes the target speeds of the hydraulic actuators 11, 12, and 13 on the basis of the distance D computed in Step S3 and the operation amounts (voltage values) of the operation levers input from the operation device 24 in such a manner that the bucket tip end P4 is held on or above the target surface 60 even if the work device 7 operates.

In Step S5, the work mode selection section 39 determines whether or not the distance D computed in Step S3 is smaller than the distance threshold D0. In a case of determining by this determination that the distance D is smaller than the distance threshold D0, the work mode selection section 39 goes to Step S6; otherwise (that is, in a case in which the distance D is equal to or larger than the distance threshold D0), the work mode selection section 39 goes to Step S9.

In Step S6, the work mode selection section 39 determines whether or not the magnitude of the target speed Va1 of the arm cylinder 12 computed in Step S4 is equal to or lower than the speed threshold Va1max (that is, V0). In a case of determining by this determination that the target speed Va1 of the arm cylinder 12 is equal to or lower than the speed threshold Va1max, the work mode selection section 39 goes to Step S7; otherwise (that is, in a case in which the target speed Va1 is higher than the speed threshold Va1max), the work mode selection section 39 goes to Step S9.

In Step S7, the work mode selection section 39 selects the second mode (controllability priority mode) as the work mode of the hydraulic excavator 1.

In Step S8, the second mode control section 40*a*2 in the arm flow control valve control section 40*a* computes a signal for driving the first flow control valve (first arm spool) 28, and outputs the signal to the solenoid valve 32*a* or 32*b*, and the second mode control section 40*a*2 goes to Step S11.

In Step S11, the boom flow control valve control section 40*b* computes a signal for driving the second flow control valve (boom spool) 31, and outputs the signal to the solenoid valve 31*a* or 31*b*, and the boom flow control valve control section 40*b* goes to Step S12.

In Step S12, the bucket flow control valve control section 40*c* computes a signal for driving the flow control valve (bucket spool) 30 and outputs the signal to the solenoid valve 34*a* or 34*b*. When a process in Step S12 is over, the controller 25 returns to Start and repeats processes in Steps S1 and the following upon confirming that the operator's operating the operation device 24 continues. It is noted that in a case in which operator's operating the operation device 24 is over even in the middle of the flow of FIG. 10, the controller 25 ends the processes and waits until the operator starts operating the operation device 24 next time.

In Step S9, the work mode selection section 39 selects the first mode (operability priority mode) as the work mode of the hydraulic excavator 1.

In Step S10, the first mode control section 40*a*1 in the arm flow control valve control section 40*a* computes signals for driving the first flow control valve (first arm spool) 28 and the third flow control valve (second arm spool) 29, and outputs the signals to the solenoid valves 32*a* and 33*a* or the solenoid valves 32*b* and 33*b*, and the first mode control section 40*a*1 goes to Step S11. Since subsequent processes are already described, description will be omitted.

<Operations and Advantages>

In the work machine in the present embodiment configured as described above, in the case in which the distance D is smaller than the distance threshold D0 and the target speed Va1 of the arm cylinder 12 is equal to or lower than the maximum speed Va1max at which the hydraulic operating fluid can be supplied from the first hydraulic pump 14, the controller 25 (work mode selection section 39) automatically selects the second work mode for prioritizing the controllability of the work device 7. In the scene in which the second work mode is selected, compared with the case in which the first work mode is selected, the bucket tip end P4 that is the control point of the work device 7 is relatively close to the target surface 60 and finishing work for making a finished work quality close to the target surface 60 by moving the bucket tip end P4 along the target surface 60 is often carried out. Since the arm operation amount is often comparatively small in the finishing work, the controllability is more important than the operability.

In the case in which the second work mode is selected, the second mode control section 40*a*2 controls the arm cylinder 12. In this case, the second mode control section 40*a*2 drives only the first flow control valve (first arm spool) 28 to control the arm cylinder 12, and holds the third flow control valve (second arm spool) 29 connected in parallel to the second flow control valve (boom spool) 31 used for controlling the boom cylinder 11 at a neutral position and does not use the third flow control valve (second arm spool) 29 for controlling the arm cylinder 12. In other words, the arm cylinder 12 and the boom cylinder 11 are driven by the hydraulic operating fluids from the different hydraulic pumps and occurrence of diversion of the hydraulic operating fluids between the arm cylinder 12 and the boom cylinder 11 is prevented. This can eliminate a variation in the flow rate of the hydraulic operating fluid guided to the arm cylinder 11 in response to magnitudes of loads on the arm cylinder 12 and the boom cylinder 11; thus, the arm cylinder 12 and the boom cylinder 11 can be accurately controlled on the basis of the target speeds computed by the target speed computing section 38. It is, therefore, possible to make the finished work quality formed by the work device 7 close to the target surface 60.

On the other hand, in the case in which the distance D is larger than the distance threshold D0 or the target speed Va1 of the arm cylinder 12 is higher than the maximum speed Va1max at which the hydraulic operating fluid can be supplied from the first hydraulic pump 14, the controller 25 (work mode selection section 39) automatically selects the first work mode for prioritizing the responsiveness and the operability of the work device 7. In the scene in which the first work mode is selected, compared with the case in which the second work mode is selected, the bucket tip end P4 is at a position relatively far from the target surface 60, and coarse excavation work for efficiently proceeding with excavation work by operating the arm 9 for arm crowding as speedily as possible in a range in which the bucket tip end P4 does not enter below the target surface 60 is often carried out. Since a priority is given to work efficiency per time in the coarse excavation work and the arm operation amount is often comparatively large, the responsiveness and the operability are more important than the controllability.

In the case in which the first work mode is selected, the first mode control section 40*a*1 controls the arm cylinder 12. In this case, the first mode control section 40*a*1 controls the arm cylinder 12 using both the first flow control valve (first arm spool) 28 and the third flow control valve (second arm spool) 29. In other words, while the diversion of the hydraulic operating fluids between the arm cylinder 12 and the boom cylinder 11 is permitted, the arm cylinder 12 is driven by the hydraulic operating fluids from the two hydraulic pumps 14 and 15. This makes it possible to promptly guide the hydraulic operating fluids at the flow rates conformable to the arm operation amount; thus, the arm cylinder 12 operates with high responsiveness to the operator's operation and favorable operability can be obtained.

In other words, according to the present embodiment, it is possible to accurately control the hydraulic actuators irrespectively of the loads when the controllability is prioritized, and the favorable operability can be obtained when the operability is prioritized.

Particularly in Embodiment 1 described above, the controller 25 is configured such that the first mode is automatically selected irrespectively of the distance D in the case in which the target speed Va1 of the arm cylinder 12 is higher than the maximum speed Va1max at which the hydraulic operating fluid can be supplied from the first hydraulic pump 14. Owing to this, even in the scene in which the distance D is smaller than the distance threshold D0, the arm cylinder 12 is permitted to operate quickly when the arm cylinder 12 is required to operate quickly. In other words, even in the case in which the bucket tip end P4 is in the vicinity of the target surface 60, the arm cylinder 12 can be controlled to operate quickly as needed, thereby avoiding considerable impairment of the operability.

Figure 16:
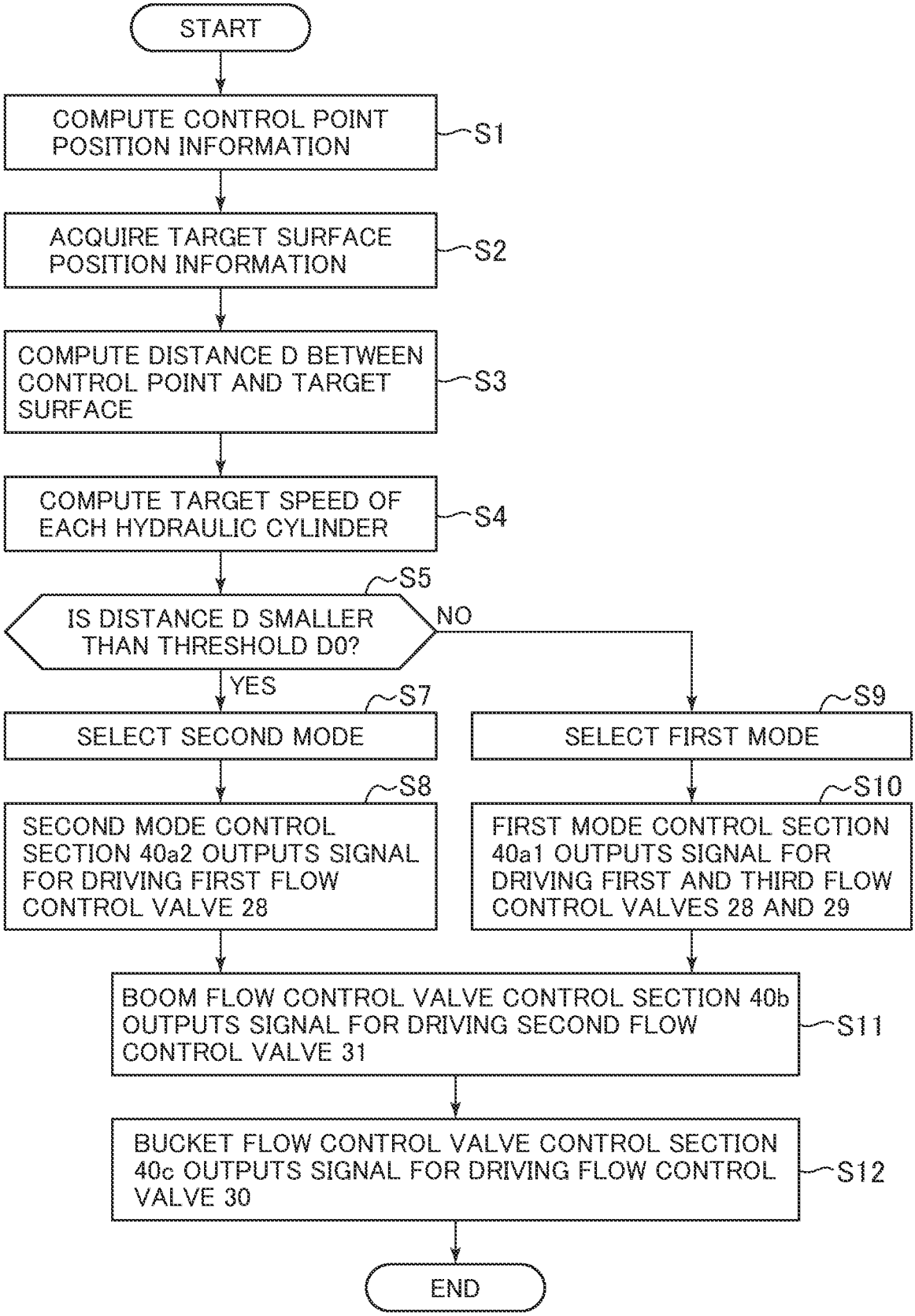
FIG. 16 is a flowchart representing a modification of the control flow by the controller 25 according to Embodiment 1.

While the work mode selection section 39 is configured such that the first mode is selected irrespectively of the distance D in the case in which the target speed Va1 of the arm cylinder 12 is higher than the maximum speed Va1max at which the hydraulic operating fluid can be supplied from the first hydraulic pump 14 in Embodiment 1 described above, this configuration is optional. In other words, the work mode selection section 39 may be configured to select the first work mode when the distance D is equal to or larger than the distance threshold D0 and to select the second work mode when the distance D is smaller than the distance threshold D0. A flowchart by the controller 25 in this case is depicted in FIG. 16. The flowchart of FIG. 16 is configured such that Step S6 is omitted from the flowchart of FIG. 10 and the work mode selection section 39 goes to Step S7 in the case in which a determination result is YES in Step S5. In this case, similarly to the case of FIG. 10, it is possible to accurately control the hydraulic actuators irrespectively of the loads when the controllability is prioritized, and the favorable operability can be obtained when the operability is prioritized.

Embodiment 2

Figure 11:
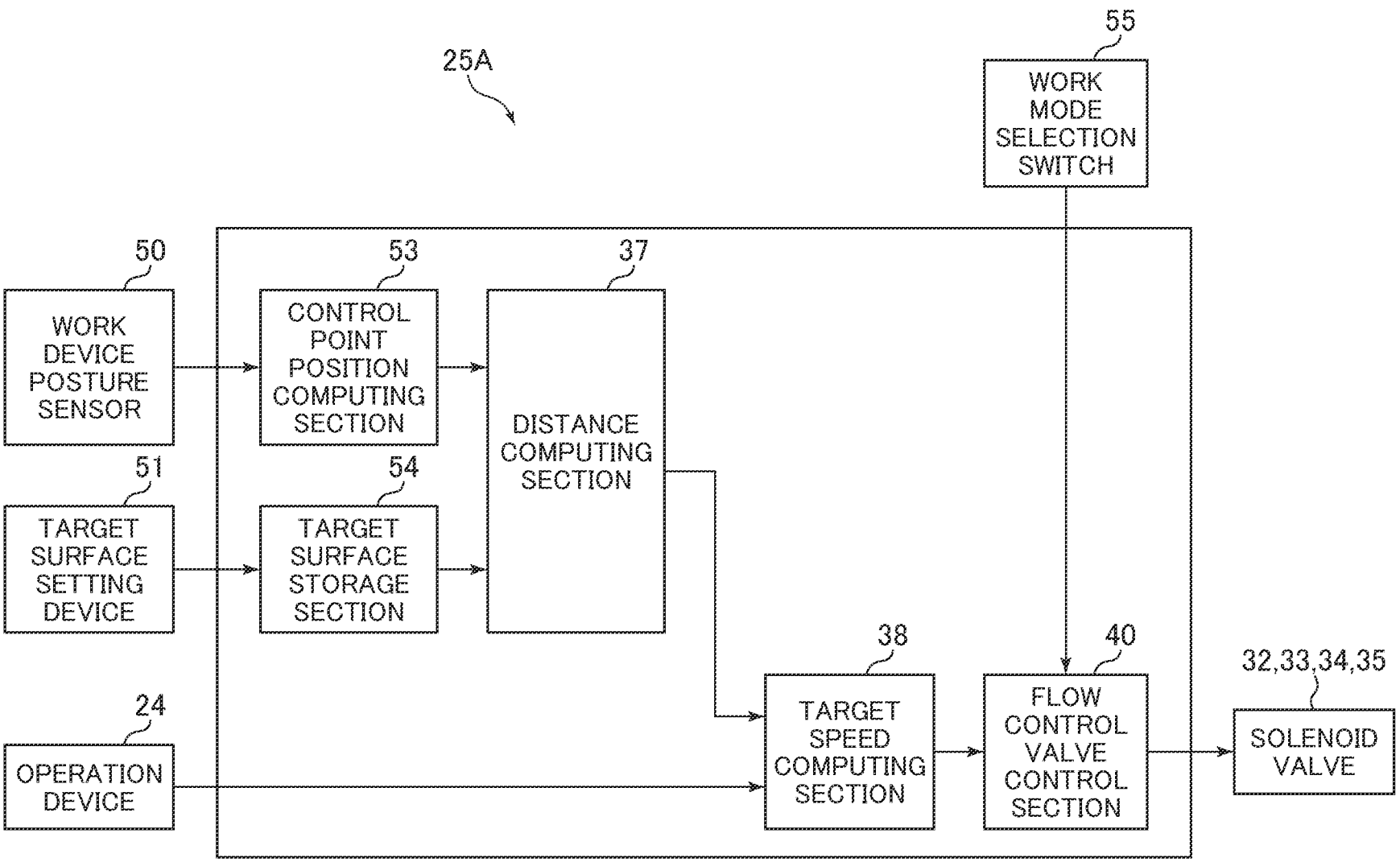
FIG. 11 is a functional block diagram of a controller 25A of a work machine according to Embodiment 2 of the present invention.

FIG. 11 is a functional block diagram of a controller 25A of a work machine according to Embodiment 2 of the present invention and a configuration diagram around the controller 25. The controller 25A is not configured with the work mode selection section 39, and the flow control valve control section 40 in the controller 25A executes control over the solenoid valves 32, 33, 34, and 35 on the basis of a signal from a work mode selection switch 55. Since the other hardware configurations are the same as those in the preceding embodiment, description of the other hardware configurations will be omitted.

The work mode selection switch 55 is a switch for selecting one of the first mode and the second mode as the work mode of the hydraulic excavator 1, and is provided, for example, in or around the operation device 24 within the operation room 4. Changeover positions of the work mode selection switch 55 include a first position at which the first mode is selected and a second position at which the second mode is selected. In a case in which the position of the work mode selection switch 55 is changed over to the first position, the work mode selection switch 55 outputs a signal (first mode selection signal) indicating that the first mode is selected to the arm flow control valve control section 40*a* in the flow control valve control section 40. On the other hand, in a case in which the position is changed over to the second position, the work mode selection switch 55 outputs a signal (second mode selection signal) indicating that the second mode is selected to the arm flow control valve control section 40*a* in the flow control valve control section 40.

The arm flow control valve control section 40*a* causes the first mode control section 40*a*1 to control the arm cylinder 12 in a case in which the first mode selection signal is input to the arm flow control valve control section 40*a* from the work mode selection switch 55, and causes the second mode control section 40*a*2 to control the arm cylinder 12 in a case in which the second mode selection signal is input thereto.

Figure 12:
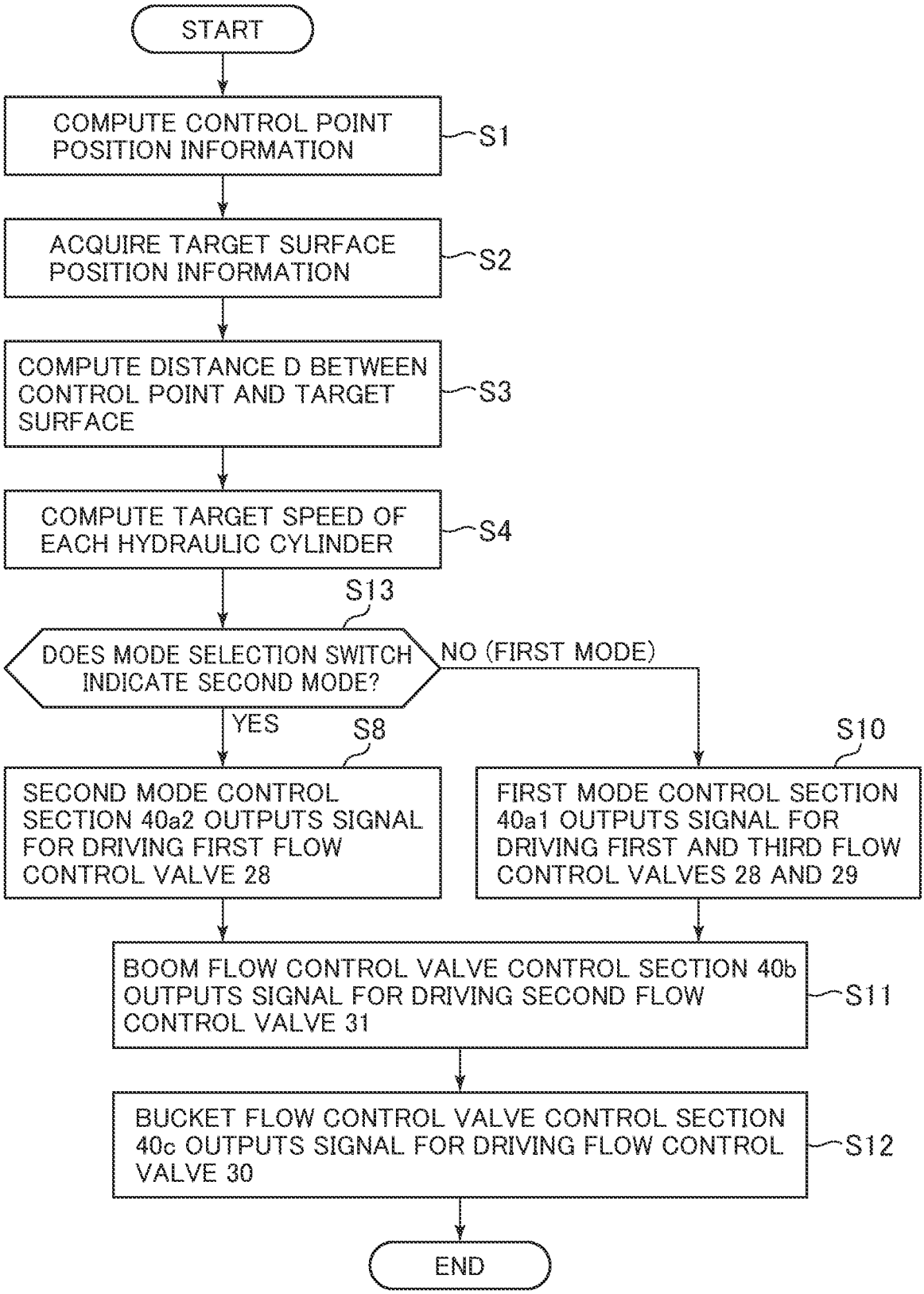
FIG. 12 is a flowchart representing a control flow by the controller 25A according to Embodiment 2.

FIG. 12 is a flowchart representing a control flow by the controller 25A according to the present embodiment. Since processes denoted by the same reference characters as those in FIG. 10 are the same as the processes in FIG. 10, description of the processes will be omitted.

In Step S13, the flow control valve control section 40 determines whether or not the position of the mode selection switch 55 is changed over to the second position corresponding to the second mode on the basis of whether or not the signal input from the work mode selection switch 55 is the second mode selection signal. In a case in which the signal input from the work mode selection switch 55 is the second mode selection signal, the flow control valve control section 40 determines to cause the second mode control section 40*a*2 to control the arm cylinder 12 and goes to Step S8. On the other hand, in a case in which the signal input from the work mode selection switch 55 is the first mode selection signal, the flow control valve control section 40 determines to cause the first mode control section 40*a*1 to control the arm cylinder 12 and goes to Step S10.

According to the work machine configured as described above, operating the work mode selection switch 55 enables the operator to change over the work mode of the hydraulic excavator 1 at desired timing; thus, it is possible to exercise actuator control conformable to an operator's intention.

Embodiment 3

As Embodiment 3, a case in which three hydraulic pumps are mounted in the hydraulic excavator 1 will be described. It is noted that description of parts common to the respective embodiments described above will be omitted.

Figure 13:
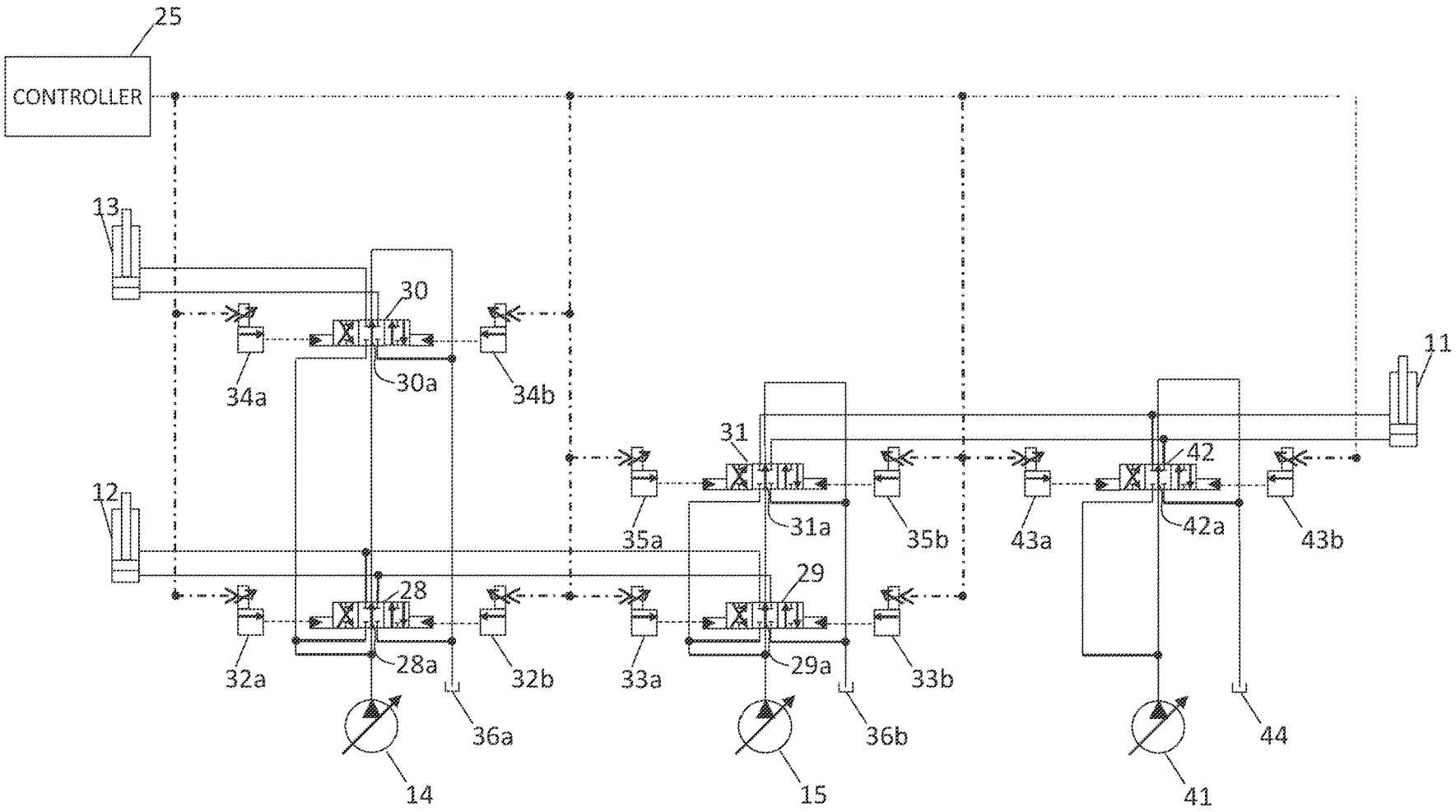
FIG. 13 is a schematic diagram of a hydraulic circuit of the hydraulic excavator 1 according to Embodiment 3.

FIG. 13 is a schematic diagram of a hydraulic circuit of the hydraulic excavator 1 according to Embodiment 3. This hydraulic circuit is configured with, in addition to the constituent elements of the hydraulic circuit in Embodiment 1 depicted in FIG. 5, a third hydraulic pump 41 driven by the engine 16, a second boom spool 42 that is a fourth flow control valve controlling a flow rate of a hydraulic operating fluid supplied from the third hydraulic pump 41 to the boom cylinder 11, second boom spool drive solenoid valves 43*a* and 43*b* driving the second boom spool 42, and a hydraulic operating fluid tank 44.

The second boom spool 42 similarly has a center bypass section 42*a* that is a flow path for guiding the hydraulic operating fluid delivered from the hydraulic pump 41 to the hydraulic operating fluid tank 44 until the second boom spool 42 reaches a predetermined spool position from a neutral position. In the present embodiment, the third hydraulic pump 41, the center bypass section 42*a* of the second boom spool 42, and the tank 44 are connected in series in this order, and the center bypass section 42*a* configures a center bypass line that guides the hydraulic operating fluid delivered from the third hydraulic pump 41 to the tank 44.

Figure 14:
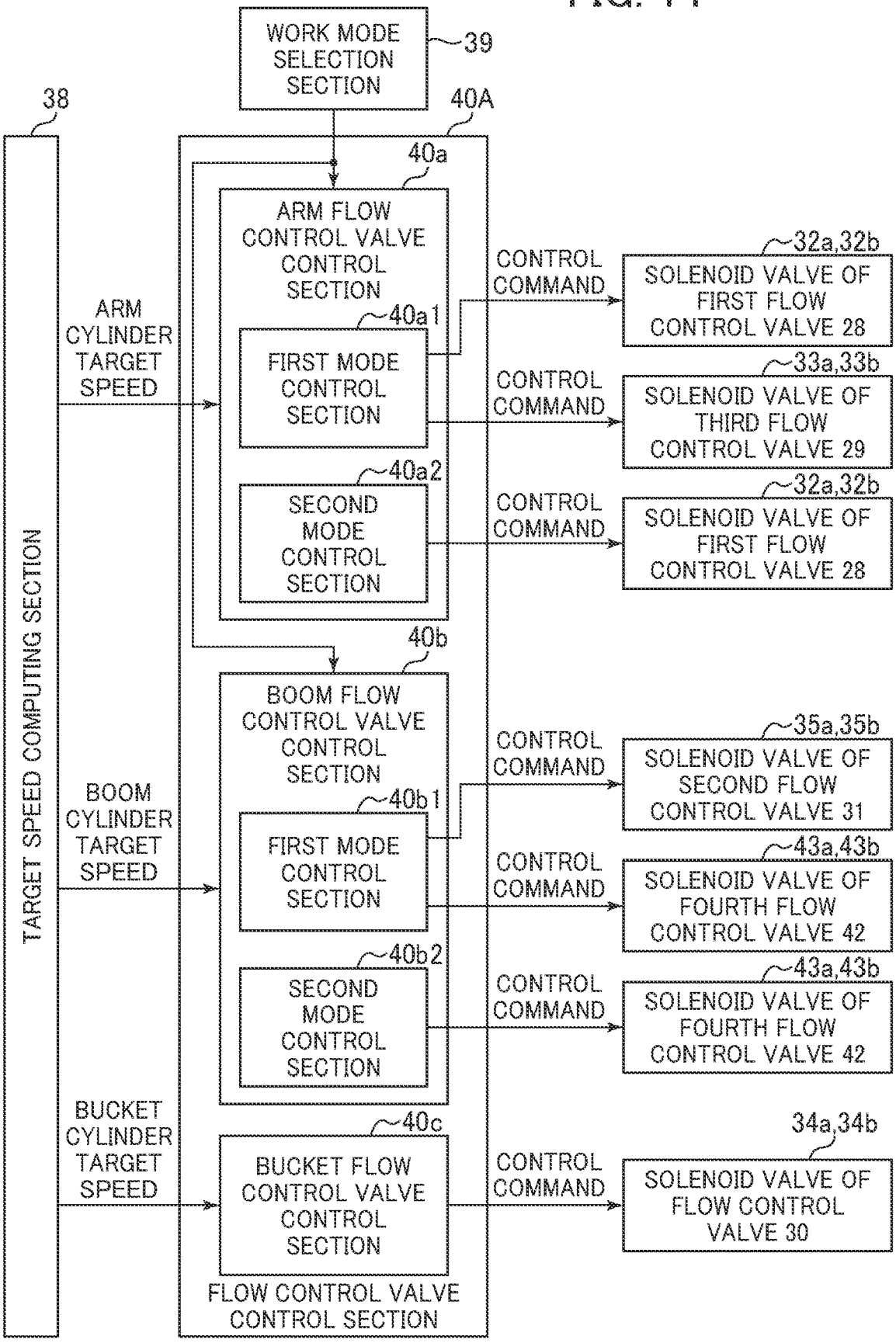
FIG. 14 is a functional block diagram of a flow control valve control section 40A according to Embodiment 3.

FIG. 14 is a functional block diagram of a flow control valve control section 40A according to the present embodiment. The flow control valve control section 40A has the arm flow control valve control section 40*a*, the boom flow control valve control section 40*b*, and the bucket flow control valve control section 40*c*.

The boom flow control valve control section 40*b* is configured with a first mode control section 40*b*1 used when the first mode is selected as the work mode of the hydraulic excavator 1, and a second mode control section 40*b*2 used when the second mode is selected as the work mode of the hydraulic excavator 1. With this configuration, the first mode control section 40*b*1 in the boom flow control valve control section 40*b* controls the second flow control valve (first boom spool) 31 and the fourth flow control valve (second boom spool) 42 on the basis of the target speed of the boom cylinder 11 in the case in which the first work mode is selected as the work mode of the hydraulic excavator 1. On the other hand, the second mode control section 40*b*2 in the boom flow control valve control section 40*b* controls only the fourth flow control valve (second boom spool) 42 on the basis of the target speed of the boom cylinder 11 in the case in which the second work mode is selected as the work mode of the hydraulic excavator 1.

The target speed of the boom cylinder 11 computed by the target speed computing section 38 is input to the first mode control section 40*b*1, and the first mode control section 40*b*1 computes and outputs control commands to the first boom spool drive solenoid valves 35*a* and 35*b* and the second boom spool drive solenoid valves 43*a* and 43*b* (specifically, command current values specifying valve opening degrees of the first boom spool drive solenoid valves 35*a* and 35*b* and the second boom spool drive solenoid valves 43*a* and 43*b*) corresponding to the target speed. In other words, in the case in which the first mode is selected, the boom cylinder 11 is driven by the hydraulic operating fluids guided from the two boom spools 31 and 42 (that is, two hydraulic pumps 15 and 41). In computing the control commands to the first boom spool drive solenoid valves 35*a* and 35*b* and the second boom spool drive solenoid valves 43*a* and 43*b*, the first mode control section 40*b*1 in the present embodiment uses tables in each of which a one-to-one correlation between the target speed of the boom cylinder 11 and the control commands to the first boom spool drive solenoid valves 35*a* and 35*b* and the second boom spool drive solenoid valves 43*a* and 43*b* is specified. These tables include first a table for the first boom spool drive solenoid valve 35*a* and a table for the second boom spool drive solenoid valve 43*a* as two tables used in the case of expanding the boom cylinder 11. In addition, the tables include a table for the first boom spool drive solenoid valve 35*b* and a table for the second boom spool drive solenoid valve 43*b* as two tables used in the case of contracting the boom cylinder 11. In these four tables, a correlation between the target speed and the current values to the solenoid valves 35*a*, 35*b*, 43*a*, and 43*b* is specified in such a manner that the current values monotonically increase in proportion to the increase in the magnitude of the boom cylinder target speed on the basis of a relationship between the current values to the solenoid valves 35*a*, 35*b*, 43*a*, and 43*b* and an actual speed of the boom cylinder 11 obtained by an experiment or a simulation in advance.

The target speed of the boom cylinder 11 computed by the target speed computing section 38 is input to the second mode control section 40*b*2, and the second mode control section 40*b*2 computes and outputs control commands to the second boom spool drive solenoid valves 43*a* and 43*b* (specifically, command current values specifying valve opening degrees of the second boom spool drive solenoid valves 43*a* and 43*b*) corresponding to the target speed. In other words, in the case in which the second mode is selected, the boom cylinder 11 is driven by the hydraulic operating fluid guided only from one boom spool 42 (that is, only one hydraulic pump 41). In computing the control commands to the second boom spool drive solenoid valves 43*a* and 43*b*, the second mode control section 40*b*2 in the present embodiment uses tables in each of which a one-to-one correlation between the target speed of the boom cylinder 11 and the control commands to the second boom spool drive solenoid valves 43*a* and 43*b* is specified. These tables include a table for the second boom spool drive solenoid valve 43*a* used in the case of expanding the boom cylinder 11 and a table for the second boom spool drive solenoid valve 43 used in the case of contracting the boom cylinder 11. In these two tables, a correlation between the target speed and the current values to the solenoid valves 43*a* and 43*b* is specified in such a manner that the current values monotonically increase in proportion to the increase in the magnitude of the boom cylinder target speed on the basis of the relationship between the current values to the solenoid valves 43*a* and 43*b* and the actual speed of the boom cylinder 11 obtained by the experiment or the simulation in advance.

Figure 15:
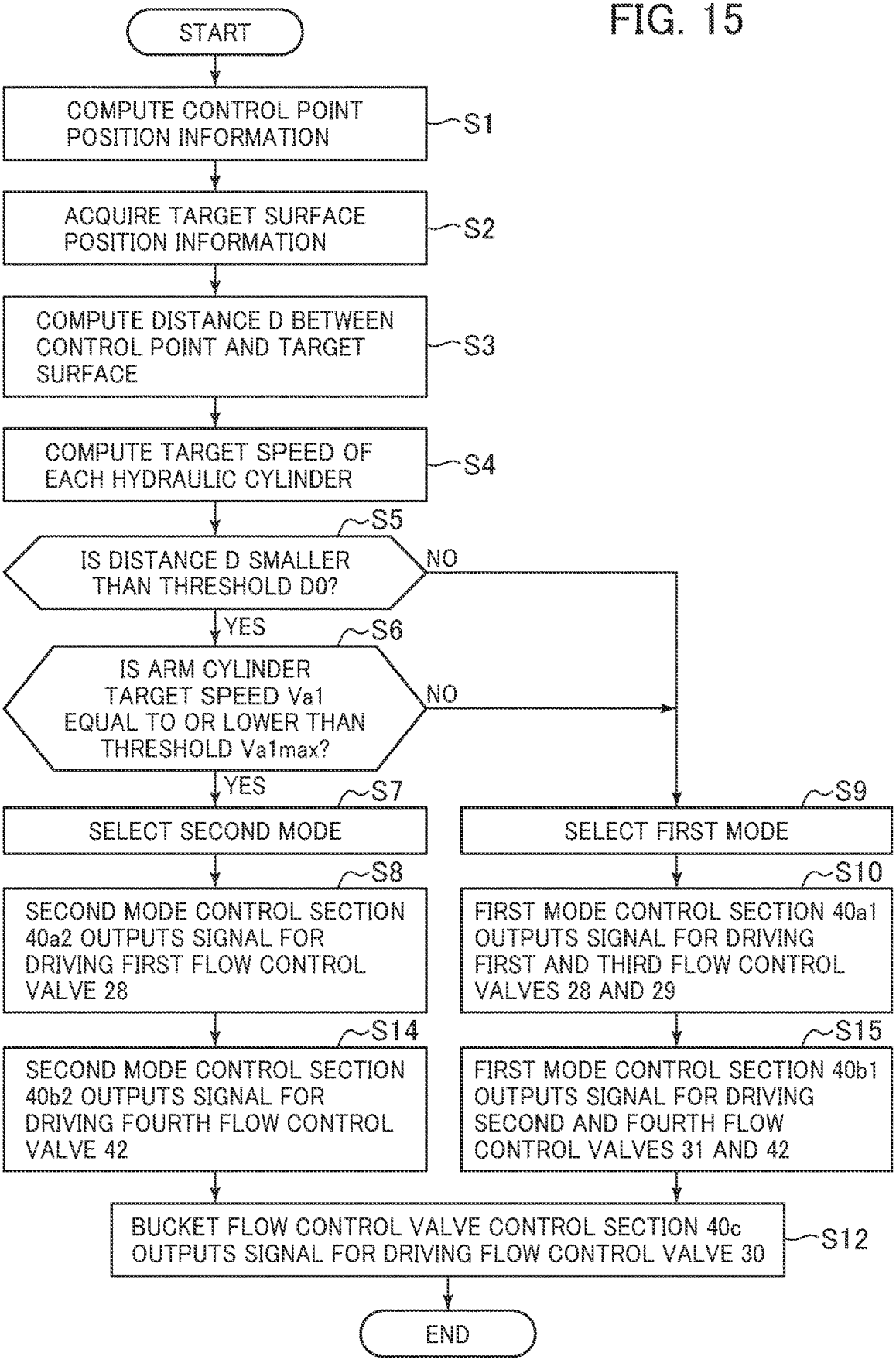
FIG. 15 is a flowchart representing a control flow by a controller according to Embodiment 3.

FIG. 15 is a flowchart representing a control flow by the controller 25 having the flow control valve control section 40A according to the present embodiment. When the operator operates the operation device 24, the controller 25 starts processes of FIG. 15. The same steps as those in the flowchart of FIG. 10 are denoted by the same reference characters and description of the steps will be often omitted.

In the case in which the second mode (controllability priority mode) is selected as the work mode of the hydraulic excavator 1 in Step S7, the second mode control section 40*a*2 in the arm flow control valve control section 40*a* computes the signal for driving the first flow control valve (first arm spool) 28, and outputs the signal to the solenoid valve 32*a* or 32*b* in Step S8, and the second mode control section 40*a*2 goes to Step S14.

In Step S14, the second mode control section 40*b*2 in the boom flow control valve control section 40*b* computes a signal for driving the fourth flow control valve (second boom spool) 42, and outputs the signal to the solenoid valve 43*a* or 43*b*, and the second mode control section 40*b*2 goes to Step S12.

On the other hand, in the case in which the first mode (operability priority mode) is selected as the work mode of the hydraulic excavator 1 in Step S9, the first mode control section 40*a*1 in the arm flow control valve control section 40*a* computes the signals for driving the first flow control valve (first arm spool) 28 and the third flow control valve (second arm spool) 29, and outputs the signals to the solenoid valves 32*a* and 33*a* or the solenoid valves 32*b* and 33*b* in Step S10, and the first mode control section 40*a*1 goes to Step S15.

In Step S15, the first mode control section 40*b*1 in the boom flow control valve control section 40*b* computes signals for driving the second flow control valve (first boom spool) 31 and the fourth flow control valve (second boom spool) 42, and outputs the signals to the solenoid valves 35*a* and 43*a* or the solenoid valves 35*b* and 43*b*, and the first mode control section 40*b*1 goes to Step S12.

In Step S12, the bucket flow control valve control section 40*c* computes the signal for driving the flow control valve (bucket spool) 30 and outputs the signal to the solenoid valve 34*a* or 34*b*. When the process in Step S12 is over, the controller 25 returns to Start and repeats processes in Steps S1 and the following upon confirming that the operator's operating the operation device 24 continues. It is noted that in a case in which operator's operating the operation device 24 is over even in the middle of the flow of FIG. 15, the controller 25 ends the processes and waits until the operator starts operating the operation device 24 next time.

In the work machine in the present embodiment configured as described above, the first boom spool drive solenoid valves 35*a* and 35*b* and the second boom spool drive solenoid valves 43*a* and 43*b* are controlled to drive the boom cylinder 11 when the distance D between the control point and the target surface 60 is equal to or larger than the distance threshold D0, and the second boom spool drive solenoid valves 43*a* and 43*b* are controlled to drive the boom cylinder 11 when the distance D is smaller than the distance threshold D0. Driving the boom cylinder 11 in response to the distance D in this way makes it possible to prevent diversion of the fluid from one hydraulic pump and prevent supply of the fluid to the boom cylinder 11 and the arm cylinder 12 when the distance D is smaller than the distance threshold D0, and to suppress speed variations of not only the arm 9 but also the boom 8. In addition, supplying the fluids from both the first boom spool 31 and the second boom spool 42 when the distance D is equal to or larger than the distance threshold D0 makes it possible to increase the speed of the boom cylinder 11.

<Others>

The present invention is not limited to the above embodiments but encompasses various modifications without departing from the spirit of the invention. For example, the present invention is not limited to the work machine configured with all the configurations described in the above embodiments but encompasses the work machine from which a part of the configurations is deleted. Furthermore, a part of the configurations according to a certain embodiment can be added to or can replace configurations according to the other embodiment.

For example, the correction coefficient k is not limited to that specified in FIG. 7 and the other value may be used as the correction coefficient k as long as the correction coefficient is a coefficient for correcting the speed vector in such a manner that the vertical component V1*z* of the speed vector is close to zero as the distance D is close to zero in a positive range.

While it has been described that the arm cylinder 12, the boom cylinder 11, and the bucket cylinder 13 are controlled in this order for the sake of convenience of description in Steps S8, S10, S11, and S12 of FIG. 10, the cylinders 11, 12, and 13 may be controlled simultaneously in parallel. Furthermore, in a case of controlling the cylinders 11, 12, and 13 in order, the cylinders 11, 12, and 13 can be controlled in an arbitrary order other than the order described with reference to FIG. 10. Moreover, in a case in which the same result is obtained for the other steps, the order may be changed to the arbitrary order. The same thing is true for the flowcharts of FIGS. 12 and 15.

DESCRIPTION OF REFERENCE CHARACTERS

1: Hydraulic excavator (work machine)
2: Travel structure
3: Swing structure
4: Operation room
5: Machine room
6: Counterweight
7: Work device
8: Boom
9: Arm
10: Bucket
11: Boom cylinder
12: Arm cylinder
13: Bucket cylinder
14: First hydraulic pump
15: Second hydraulic pump
16: Engine (prime mover)
17: Machine body inclination sensor
18: Boom inclination sensor
19: Arm inclination sensor
20: Bucket inclination sensor
21: First GNSS antenna
22: Second GNSS antenna
23: Machine body control system

24: Operation device
25, 25A: Controller
26: Flow control valve device
27: Hydraulic circuit
28: First arm spool (first flow control valve)
29: Second arm spool (third flow control valve)
30: Bucket spool
31: Boom spool (second flow control valve)
32*a*, 32*b*: First arm spool drive solenoid valve
33*a*, 33*b*: Second arm spool drive solenoid valve
34*a*, 34*b*: Bucket spool drive solenoid valve
35*a*, 35*b*: Boom spool drive solenoid valve
36*a*, 36*b*: Hydraulic operating fluid tank
37: Distance computing section
38: Target speed computing section
39: Work mode selection section
40, 40A: Flow control valve control section
40*a*: Arm flow control valve control section
40*a*1: Arm first mode control section
40*a*2: Arm second mode control section
40*b*: Boom flow control valve control section
40*b*1: Boom first mode control section
40*b*2: Boom second mode control section
40*c*: Bucket flow control valve control section
41: Third hydraulic pump
42: Second boom spool (fourth flow control valve)
43*a*, 43*b*: Second boom spool drive solenoid valve
44: Hydraulic operating fluid tank
50: Work device posture sensor
51: Target surface setting device
53: Control point position computing section
54: Target surface storage section
55: Work mode selection switch
60: Target surface

The invention claimed is:

1. A work machine comprising:

a multijoint work device having an arm and a boom;

a plurality of hydraulic actuators that includes an arm cylinder for driving the arm and a boom cylinder for driving the boom;

an operation device for operating the work device;

a first hydraulic pump and a second hydraulic pump driven by a prime mover;

a first flow control valve that controls a flow rate of a hydraulic operating fluid supplied from the first hydraulic pump to the arm cylinder;

a second flow control valve that controls a flow rate of a hydraulic operating fluid supplied from the second hydraulic pump to the boom cylinder;

a third flow control valve that controls a flow rate of the hydraulic operating fluid supplied from the second hydraulic pump to the arm cylinder; and a control device that controls the first, second, and third flow control valves, wherein the control device includes a control point position computing section configured to compute position information regarding a predetermined control point of the work device from posture information regarding the work device, a distance computing section configured to compute a distance between the control point and a predetermined target surface on a basis of the position information regarding the control point and position information regarding the predetermined target surface, a target speed computing section configured to compute target speeds of the arm cylinder and the boom cylinder in response to the distance in such a manner that an operating range of the work device is limited on and above the target surface, and a flow control valve control section configured:

to control the second flow control valve on a basis of the target speed of the boom cylinder while controlling the first flow control valve and the third flow control valve on a basis of the target speed of the arm cylinder in a case in which a first work mode for prioritizing operability of the work device is selected as a work mode of the work machine, and to control the second flow control valve on the basis of the target speed of the boom cylinder while controlling the first flow control valve on the basis of the target speed of the arm cylinder in a case in which a second work mode for prioritizing controllability of the work device is selected as the work mode of the work machine.

2. The work machine according to claim 1, wherein the distance between the control point and the target surface is assumed as being positive when the control point is located above the target surface, and the control device further includes a work mode selection section configured to select the first work mode when the distance is equal to or larger than a predetermined distance threshold, and to select the second work mode when the distance is smaller than the distance threshold.

3. The work machine according to claim 2, wherein the distance threshold is equal to or larger than 0.

4. The work machine according to claim 1, wherein the distance between the control point and the target surface is assumed as being positive when the control point is located above the target surface, and the control device further include a work mode selection section configured to select the first work mode when the target speed of the arm cylinder is higher than a predetermined speed threshold or when the distance is equal to or larger than a predetermined distance threshold, and to select the second work mode when the target speed of the arm cylinder is lower than the speed threshold and the distance is smaller than the distance threshold.

5. The work machine according to claim 4, wherein the speed threshold is a speed of the arm cylinder corresponding to a maximum flow rate at which the hydraulic operating fluid capable of being supplied from the first hydraulic pump.

6. The work machine according to claim 1, further comprising:

a third hydraulic pump driven by the prime mover; and a fourth flow control valve that controls a flow rate of a hydraulic operating fluid supplied from the third hydraulic pump to the boom cylinder, wherein the flow control valve control section controls the second flow control valve and the fourth flow control valve on the basis of the target speed of the boom cylinder while controlling the first flow control valve and the third flow control valve on the basis of the target speed of the arm cylinder in the case in which the first work mode is selected, and controls the fourth flow control valve on the basis of the target speed of the boom cylinder while controlling the first flow control valve on the basis of the target speed of the arm cylinder in the case in which the second work mode is selected.

* * * * *